US008573397B1

(12) United States Patent
Fager et al.

(10) Patent No.: US 8,573,397 B1
(45) Date of Patent: Nov. 5, 2013

(54) RETAIL PHONE PACKAGE

(75) Inventors: Roger Fager, Mount Horeb, WI (US); Ross Mack, Dane, WI (US)

(73) Assignee: Plastic Ingenuity, Inc., Cross Plains, WI (US)

( * ) Notice: Subject to any disclaimer, the term of this patent is extended or adjusted under 35 U.S.C. 154(b) by 227 days.

(21) Appl. No.: 13/165,771

(22) Filed: Jun. 21, 2011

(51) Int. Cl.
*B65D 73/00* (2006.01)

(52) U.S. Cl.
USPC ..... 206/469; 206/320; 206/464

(58) Field of Classification Search
USPC ..... 206/461–471, 320, 775, 776, 778; 229/120.02, 210, 221
See application file for complete search history.

(56) References Cited

U.S. PATENT DOCUMENTS

| | | | | | |
|---|---|---|---|---|---|
| 4,697,703 | A * | 10/1987 | Will | ..... | 206/438 |
| 4,750,619 | A * | 6/1988 | Cohen et al. | ..... | 206/438 |
| 5,209,354 | A * | 5/1993 | Thornhill et al. | ..... | 206/469 |
| 5,868,253 | A * | 2/1999 | Krueger et al. | ..... | 206/438 |
| 6,029,818 | A * | 2/2000 | Kumakura et al. | ..... | 206/469 |
| 6,622,864 | B1 * | 9/2003 | Debbs et al. | ..... | 206/438 |
| 6,830,149 | B2 * | 12/2004 | Merboth et al. | ..... | 206/438 |
| 2009/0321303 | A1 * | 12/2009 | Kang et al. | ..... | 206/464 |
| 2010/0181222 | A1 * | 7/2010 | Aiko et al. | ..... | 206/461 |

* cited by examiner

*Primary Examiner* — Luan K Bui
(74) *Attorney, Agent, or Firm* — Rick L. Abegglen

(57) ABSTRACT

A thermoformed package that is specially adapted to allow a cell phone (or similar product) to be partially packaged at one time and place, and then at a later time adapted for sale as a finished product with a particular brand (from a variety of brands or trademarks), and/or with a particular service plan (from a variety of rate plans or payment terms and/or languages) and/or with a particular language (or other localization) at a second time and place.

6 Claims, 29 Drawing Sheets

RETAIL PHONE PACKAGE

FIELD OF THE INVENTION

This invention relates generally to the field of containers for retail products. More particularly, the present invention relates to thermoformed containers adapted for use as retail phone packages that can be shipped as a partially assembled package, and then at a later time easily customized into a finished product for retail sale under a particular brand and/or with a particular rate plan.

BACKGROUND OF THE INVENTION

Inventory management in a retail store, in other words avoiding having either too much or too little stock on hand, is of great practical importance. Having too much inventory can lower profits because of the cost to maintain the inventory. Having too little inventory can lower profits when product is not available at the point of purchase to meet consumer demand.

Maintaining inventory in a retail environment is expensive for many reasons. The value of the inventory itself may be substantial for expensive consumer items like cell phones and other electronics. The time value of the money tied up in that inventory gets bigger as the value of the inventory climbs, and the longer the inventory sits on the shelf. The high cost of retail space is behind the rise of efficient sales operations like kiosks that can produce relatively high sales and inventory turnover with very little space. Inventory storage consumes space that could be used for other retail store operations, like product display, face to face sales, aisles, and a check out counter with cash register. For these and many other reasons, having too much inventory erodes profitability.

At the same time, it is extremely important for a retail store to have enough inventory available to meet immediate sale requirements. Not only must there be a sufficient quantity of inventory, that inventory must be made up of the right product mix, to be able to meet the changing needs and tastes of consumers. To effectively compete with lower-cost channels such as internet or mail order resellers, a retail store must be able to deliver a product in hand at the point of sale at the moment the consumer wants it, even if customer demand is variable and hard to predict.

The damage caused by insufficient inventory goes straight to the bottom line of a retail store operation. A customer who cannot buy because the retailer is out of stock may shop elsewhere, a loss of the immediate sale never to be made up. The lost sale is even more damaging if consumers begin to view the retailer as unreliable, eroding customer goodwill and possibly risking supplier relationships as sales drop off. Especially for hot items with a limited season or product lifetime and for products with a long lead-time to replenish inventory, insufficient stock can be a real problem for a retail store.

The problem of inventory management is particularly challenging for expensive consumer items like cell phones and similar devices like laptop or tablet computers, because these devices are continually evolving in terms of features and technology. The relatively short lifetimes of these types of products increases the risk that stock will become obsolete and see its resale value drop dramatically.

Inventory management for retail sales of cell phones and similar communications devices, in particular, is difficult for a second reason. These devices are sold with service contracts for connecting to cellular communication networks. Even within a particular cellular communication network provider, a particular make and model of a cell phone can be packaged and sold with a service contract under any of several brands owned by a particular cellular communication network provider (or under a store brand), under any of several different terms or rate plans (e.g. monthly or prepaid, data-heavy or no-data), and with packaging and documentation in multiple languages or other localization. Each brand, for example, could target a different market channel or demographic, even though they all connect to the same cellular network.

Thermoformed plastic containers are well known as inexpensive and highly customizable containers for the sale of a wide variety of products, everything from cell phones to deli meats. Thermoformed plastic containers are typically transparent and rigid, so they can give a consumer the ability to examine a product closely without actually touching it. They can be made tamper-resistant, to reduce the risk that the product could be damaged or contaminated. They are typically lightweight, and can be efficiently stored or shipped together in a nested fashion.

What is needed is a thermoformed container that is specially adapted to allow a cell phone (or similar product) to be partially packaged at one time and place, and then at a later time adapted for sale as a finished product with a particular brand (from a variety of brands or trademarks), and/or with a particular service plan (from a variety of rate plans or payment terms and/or languages) and/or with a particular language (or other localization) at a second time and place.

SUMMARY OF THE INVENTION

In a preferred embodiment, a retail package according to the invention can be made as a four piece package, comprising (front to back) an outer shell face, inner shell face, inner shell back, and outer shell back. When assembled, the package forms three separate compartments, comprising (front to back) a front compartment, a central compartment, and a rear compartment.

The front and central compartments are adapted to be filled with product components, and then partially or completely sealed to prevent removal of those contents prior to delivery to the end retail purchaser. For example, the front compartment can hold a phone, positioned and framed for retail display. The outer shell face can include perforations to facilitate opening of the front compartment by the ultimate retail purchaser. The central component can hold accessories like a charger and/or cables.

The rear compartment normally holds a book or other papers. Importantly, and unlike the front and central compartments, the rear compartment is adapted to allow easy one-way insertion of documents or other media that are specific to a particular service provider, brand, and/or service plan. After the documents or media are inserted, an outer sleeve bearing the brand etc. can be applied to assemble a finished product ready for retail sales display or delivery to the end retail purchaser.

This design enables a small stock of (relatively expensive) partially assembled packages (with cell phones in the front compartment and accessories in the central compartment, for example) combined with a a large stock of (relatively cheap) ancillary materials (such as documents, SIM cards, and outer sleeves) to provide an effective inventory adequate to meet immediate consumer demand for a large variety of different combinations of brands and/or service plans and/or languages.

Compared to keeping an inventory of fully assembled packages in the same number of combinations of cellular phone brands, service plans, and languages, this approach creates inventory depth by enabling a single phone in inventory to be flexibly sold under any of several different brands and/or service plans and/or languages, all in the same store right next to one another. This approach reduces inventory cost by allowing the brand, service plan and/or language for a particular phone to be finalized at a time and place closer to the final retail purchase, using inexpensive printed materials (instead of expensive cell phones) to provide inventory depth. Because the partially assembled packages have the cell phones and accessories sealed inside, this last-minute branding can be done with a minimum of risk that the accessories and phones will get shuffled, lost, or mismatched, as would be more likely if the compartments were not at least partially sealed to retain their contents.

A package according to the invention allows, for example, a cell phone and its accessories to be partially packaged at its point of manufacture in one country and then shipped in that form to a retail location or distribution center in a different country. In response to consumer demand, the partially packaged phone can then be adapted for sale in the destination country with a particular service provider, brand, and rate plan at the retail location or distribution center by combining the partially packaged phone with an outer sleeve and with documents or other ancillary materials inserted into the rear compartment.

The adaptation can even be done at a kiosk, whose very limited storage space would especially benefit from the highly efficient inventory management made possible by the present invention. This could be done each day at the kiosk to restock shelf inventory depleted by sales. It could also be done on demand when the customer chooses their desired provider, service plan, and/or language as the sale is completed.

In a first embodiment, the rear compartment is formed between the outer shell back and the inner shell back. A slit in a lateral side of the outer shell back provides an aperture into the rear compartment, for one-way insertion of sheet materials such as documents or other collateral material into that rear compartment. The inner shell back is adapted to receive and position documents or media (that are inserted through the slit) with a ramped corner in proximity to the slit on the outer shell back, and with upper and lower guide rails.

The ramped corner and the upper and lower guide rails help to guide and facilitate one-way placement of documentation or media into the rear compartment. As the documentation or media is inserted through the slit and up the ramped corner and into the rear compartment, the documentation or media slides between the guide rails to reach its final position in the rear compartment. As it slides during insertion, the documentation or media also moves up the ramped corner to a position away from the slit. This makes the aperture one-way, in that it is relatively easy to insert the documentation, but it is comparatively difficult to remove the documentation or media, except by rupturing the package as would be done by the ultimate purchaser.

Further, after the documentation or media is inserted into the rear compartment, the outer sleeve is normally applied. This means that tampering with or removing the contents of the package requires at least two steps to remove the sleeve and then rupture the package somehow. Depending on the nature of the goods, it might also be possible to allow the outer sleeve to be easily removed and replaced, and to make the aperture relatively large and two-way. This construction could enable inspection of the contents of the rear compartment by a prospective purchaser, while maintaining the integrity of the contents of the other compartments.

In a second embodiment, the adaptation to allow one-way insertion of documents is implemented by adapting the outer shell back to snap into place onto the inner shell back and the remainder of the partially assembled package. An interference fit with deep engagement channels between the inner shell back is used to form a relatively secure latch to partially or completely seal the rear compartment formed when the outer shell back is snapped into position on the inner shell back.

A first embodiment of the invention is a thermoformed package for retail sales comprising an outer shell face, an inner shell face, an inner shell back, and an outer shell back, with the outer shell face and the outer shell back joined together along their peripheries, with a front compartment between the outer shell face and the inner shell face and a rear compartment between the inner shell back and the outer shell back; with an aperture in the outer shell back shaped to pass a sheet material into the rear compartment.

A second embodiment of the invention is a thermoformed package for retail sales comprising an outer shell face, an inner shell face, an inner shell back with a rim; and an outer shell back with a deep channel, with the outer shell face and the inner shell back joined together along their peripheries to form a partially finished container that has a front compartment, where the rim of the inner shell back can be snapped onto the channel of the outer shell back with an interference fit that joins the rim and channel and forms a rear compartment between the inner shell back and the outer shell back.

A third embodiment of the invention is a method of late-branding cellular phones for retail sale.

Further objects, features, and advantages of the invention will be apparent from the following detailed description when taken in conjunction with the accompanying drawings.

DETAILED DESCRIPTION OF THE INVENTION

Figure 1A:
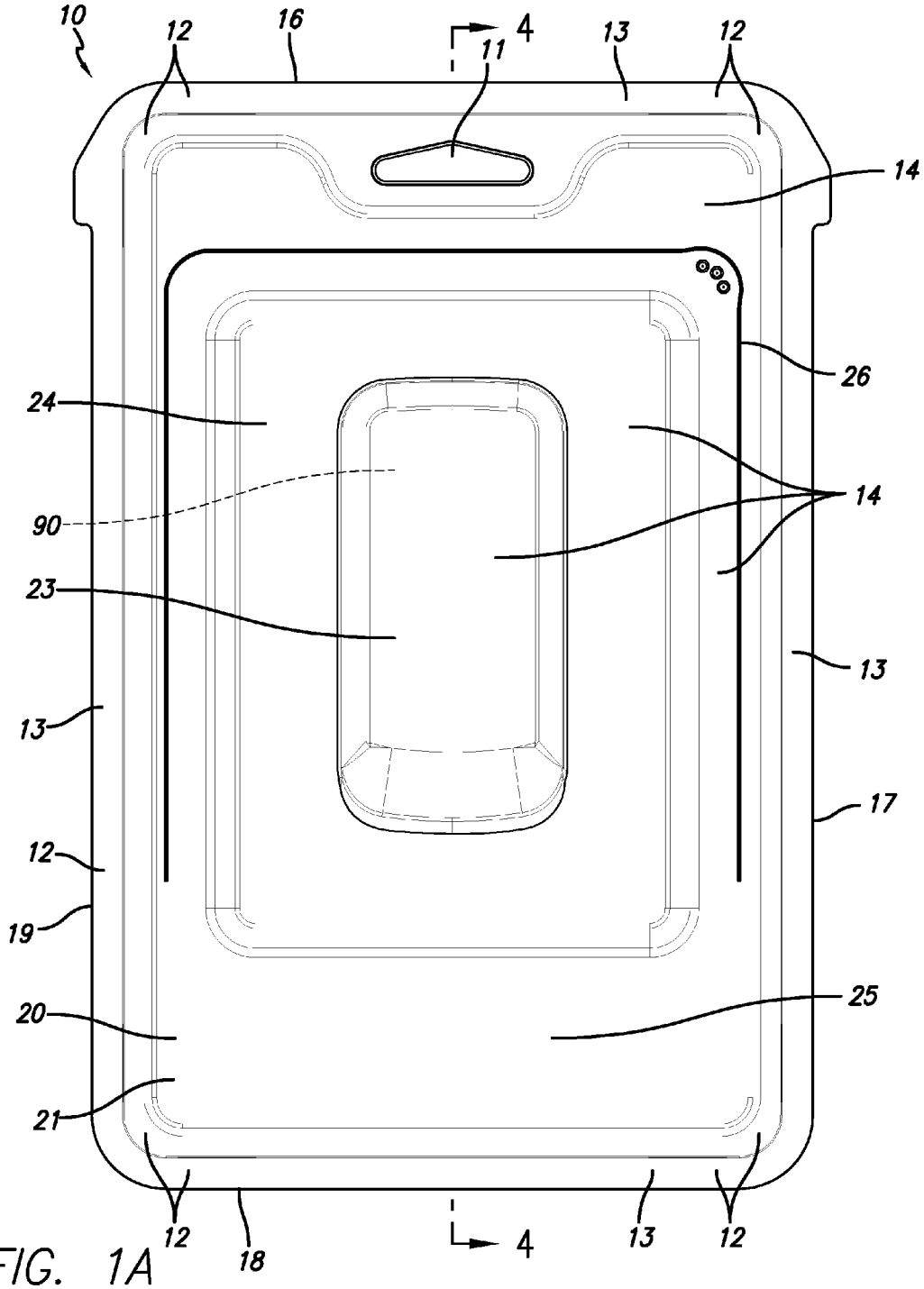
FIG. 1A is a front elevation view of an exemplary retail phone package according to a first embodiment of the invention, without the outer sleeve.

FIGS. 1A, 1B, 2, 3A, and 3B show an exemplary package 10 for retail sales of cellular telephones or similar high value objects or devices, such as computers, tablet computers, or collectible items. FIG. 1A shows the package 10 (without any outer sleeve 95) positioned to be suspended by its hanger loop 11 from a hook in a retail sales display (not shown).

Figure 1B:
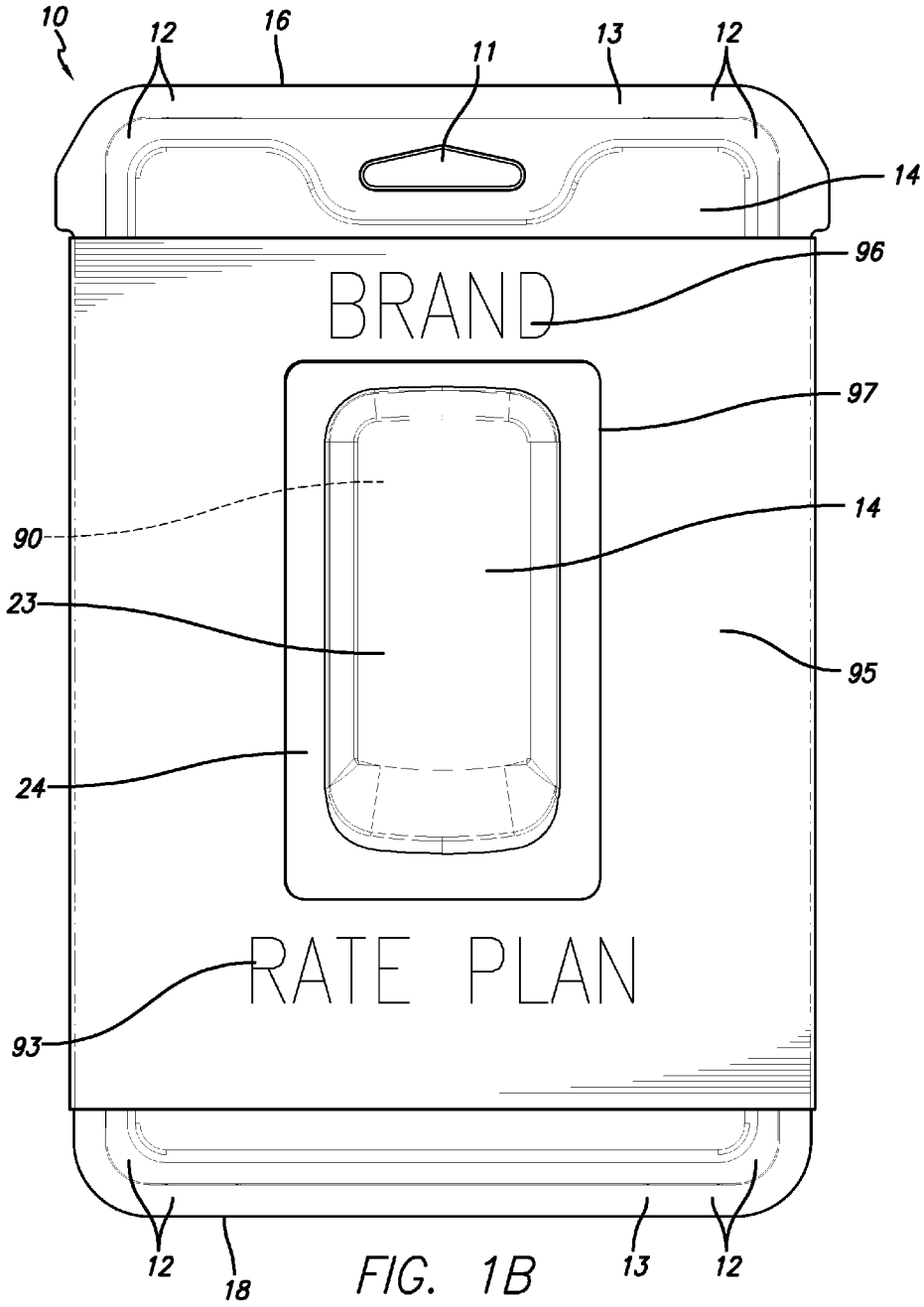
FIG. 1B is a front elevation view of the retail phone package of FIG. 1 with the outer sleeve in place.
Figure 2:
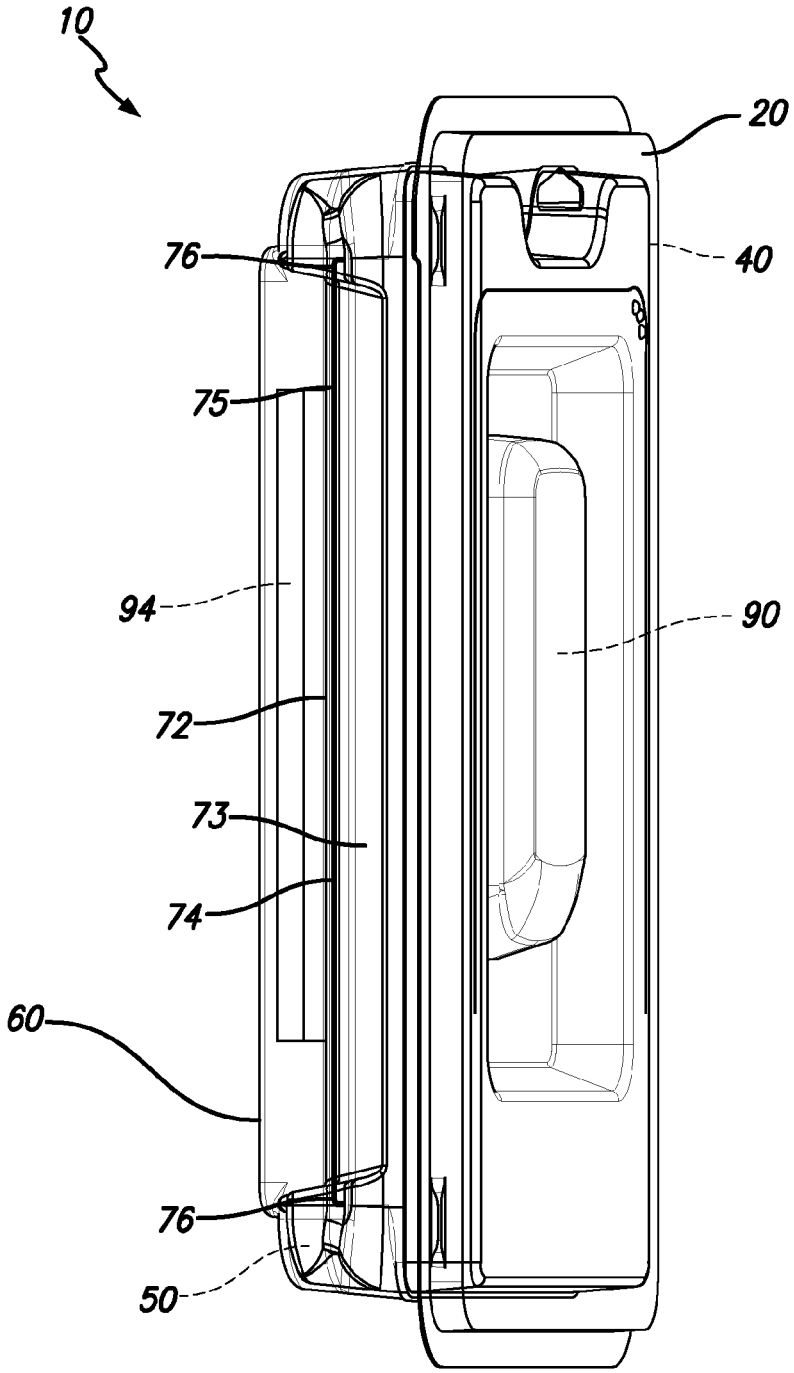
FIG. 2 is a perspective view of the package of FIG. 1, rotated to show the front side and the left (aperture) side of the package.
Figure 3A:
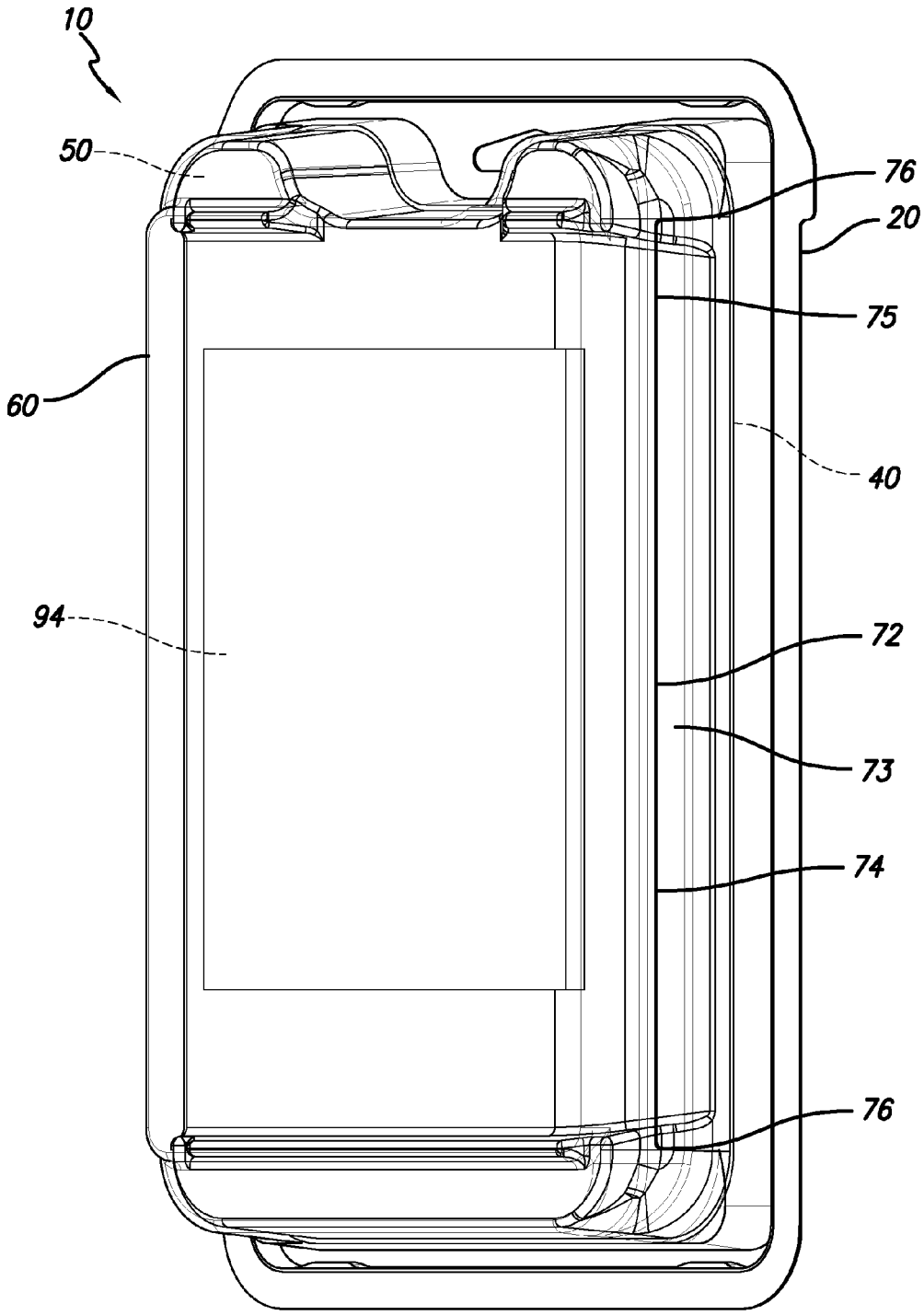
FIG. 3A is a perspective view of the package of FIG. 1, rotated to show the rear and left sides of the package.
Figure 3B:
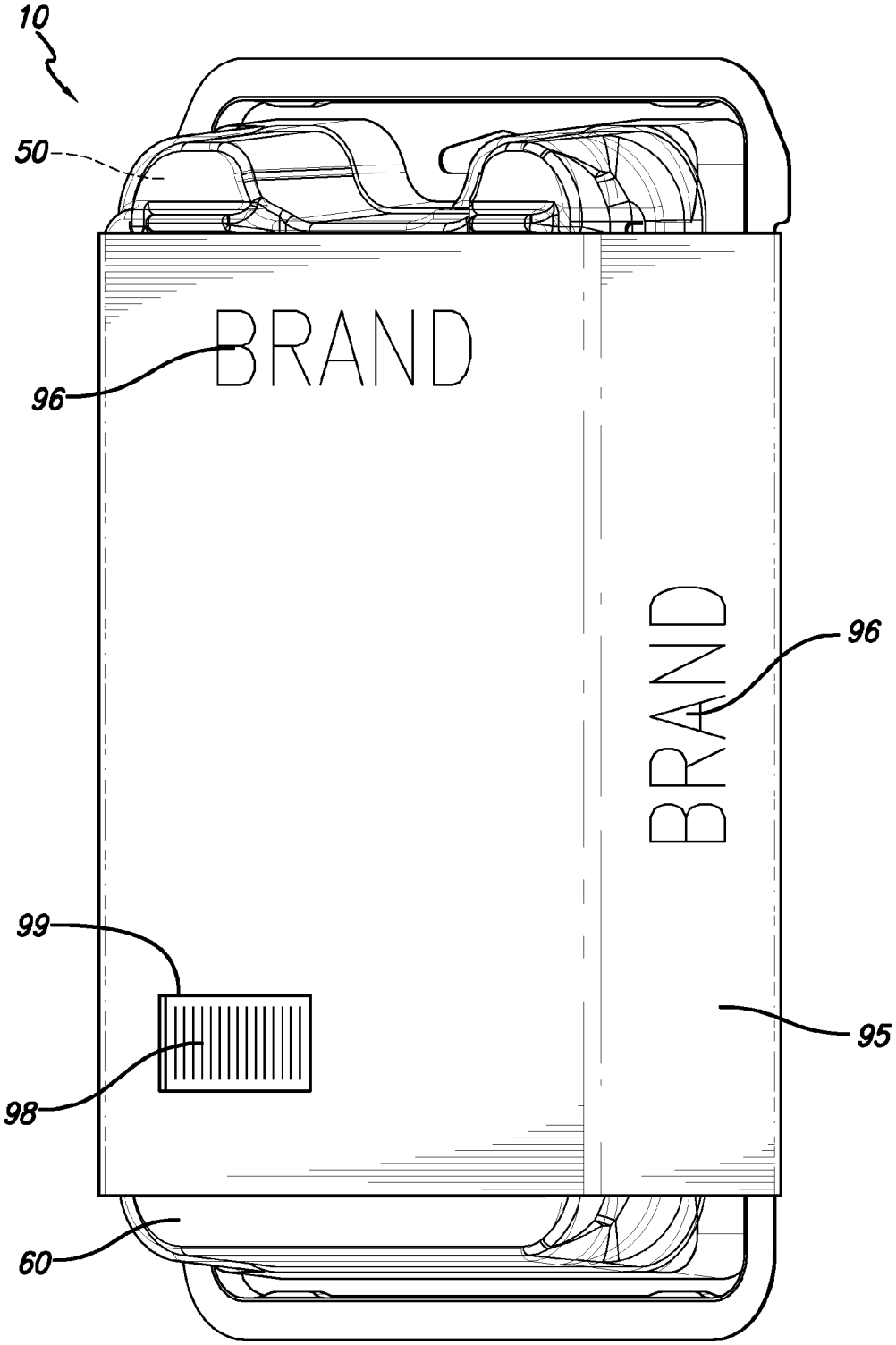
FIG. 3B is a perspective view of the package of FIG. 1, rotated to show the rear and left sides of the package, with the outer sleeve in place.

FIG. 1B shows the package 10 in an opaque or transparent outer sleeve 95, for example made of printed cardboard, bearing one or more service plans 93 and one or more brands 96 where the term brands is intended to be broadly understood to include not only conventional trademarks that indicate manufacturer, but also other identifying information such as language version. The sleeve 95 may include one or more product windows 97 cut from the outer sleeve 95 to expose areas of the package 10 or its contents. The sleeve 95 or the package 10 may bear one or more product identifiers 98 or other information about the product, such as serial numbers, radio frequency identification tags, bar codes, or Universal Product Codes ("UPC") which may be visible through an product identification window 99 in the outer sleeve 95.

The package 10 may be made from a transparent or an opaque material such as a thermoformable plastic. However, if the package is at least partially made from a transparent material, then the product identifier 98 can be placed inside the package 10, and yet remain visible through the product identification window 99. This construction can deter or prevent a method of retail theft called "UPC switching" in which a UPC code for a less expensive product is affixed to a more expensive product in order to purchase the expensive product at a fraudulent price.

The package 10 may have a hanger loop 11 for retail display, and is preferably at least partially sealed to protect its contents along a periphery 12. The periphery 12 may terminate in a flange 13. The package 10 has a front or frontispiece 14 (best shown in FIG. 1) and a rear, back, or posterior 15 (best shown in FIGS. 3A & 3B). Assuming for naming purposes that the package 10 is positioned in the orientation shown in FIG. 1, the package 10 has a top 16, a right side 17, a bottom 18, and a left side 19.

Figure 5:
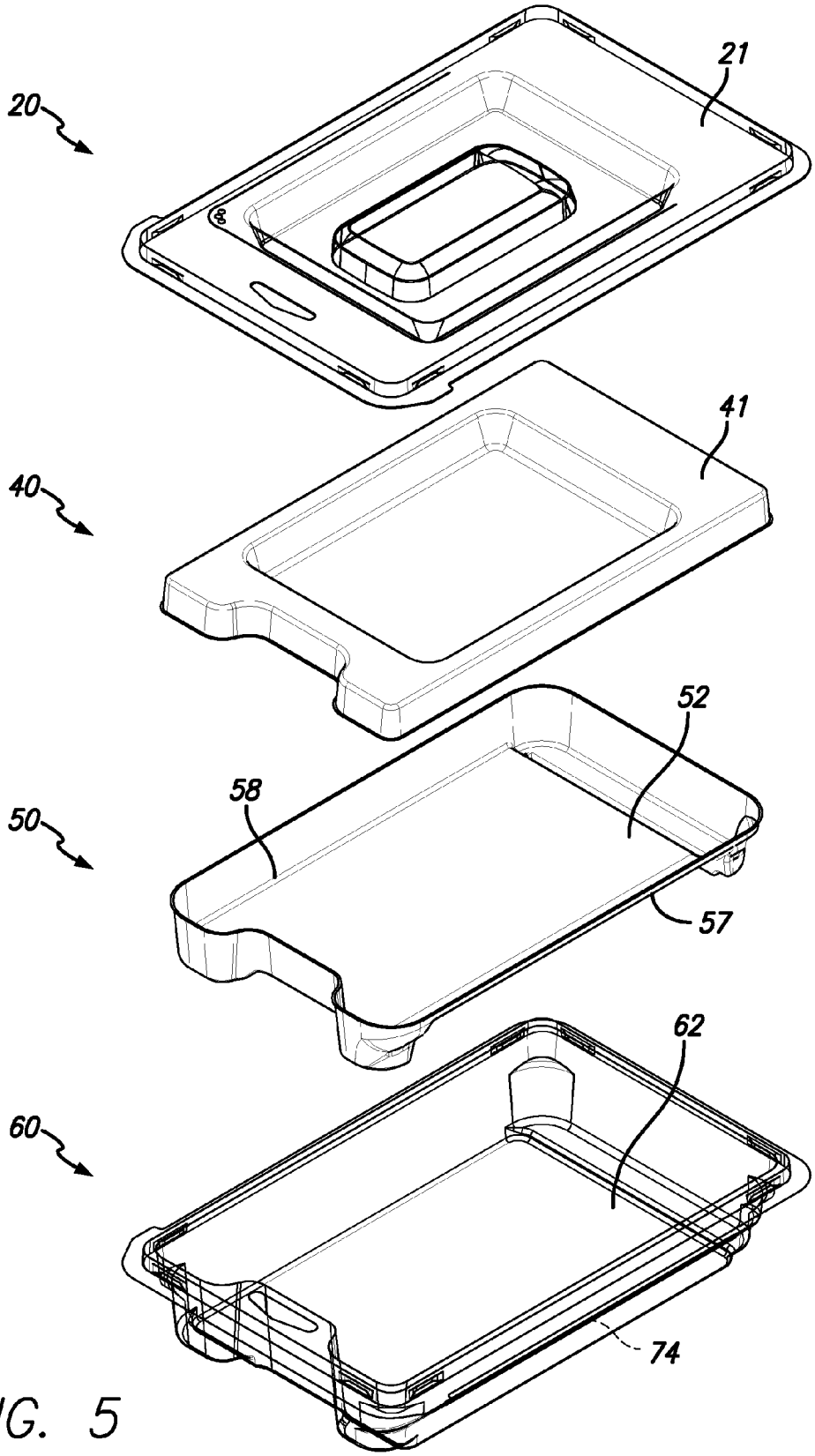
FIG. 5 is an exploded perspective view of the package of FIG. 1, rotated to expose the top, front, and left sides of the package components.
Figure 6:
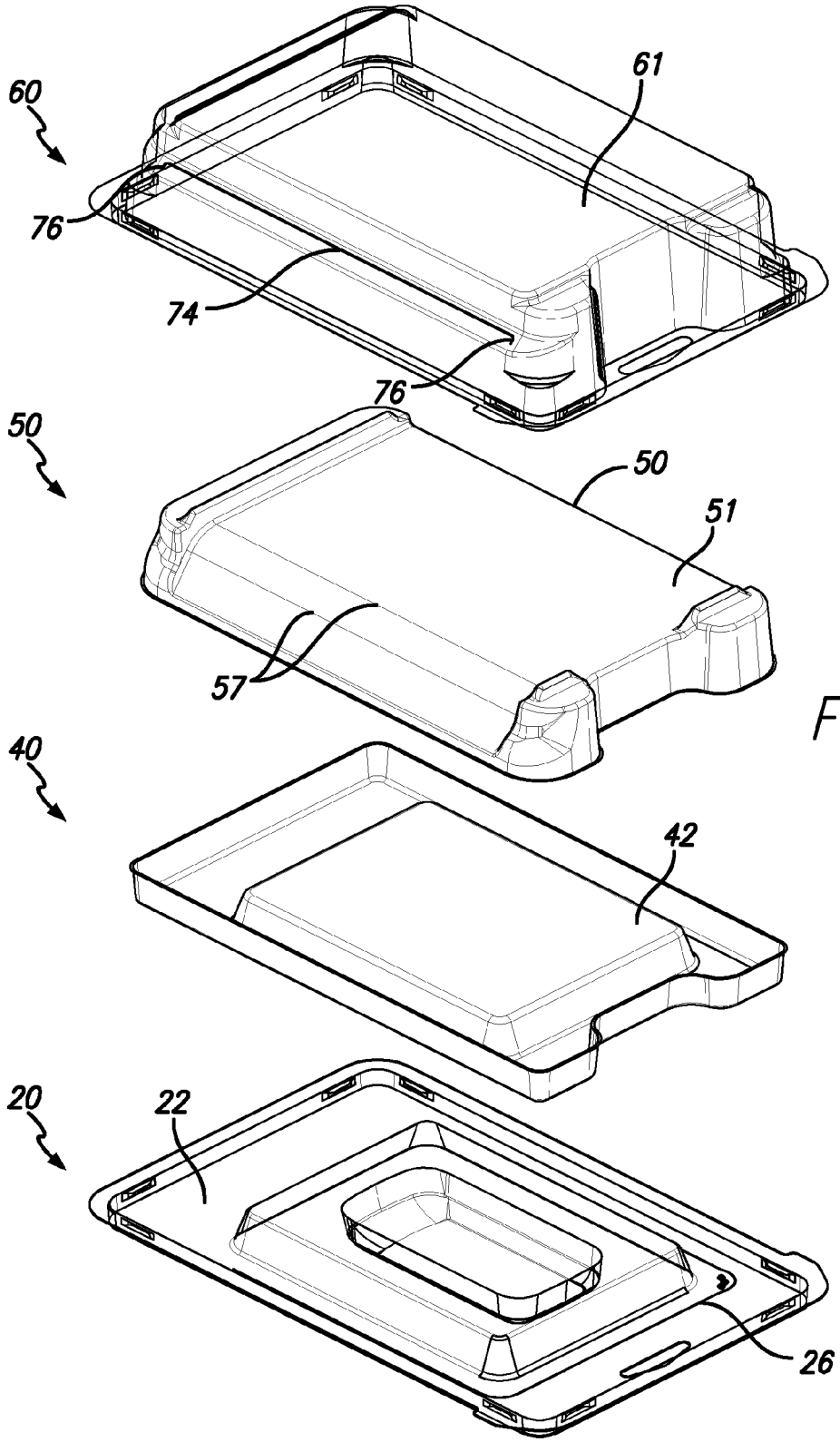
FIG. 6 is an exploded bottom perspective view of the package of FIG. 1, rotated to expose the bottom, rear, and left sides of the package components.

As perhaps best shown in the exploded views of FIGS. 5 & 6, the exemplary package 10 may comprise four pieces: an outer shell face 20, an inner shell face 40, an inner shell back 50, and an outer shell back 60. These components of the exemplary package 10 can each be made of any transparent or opaque sheet materials, for example using a thermoformable plastic and a vacuum thermoforming process.

Figure 4:
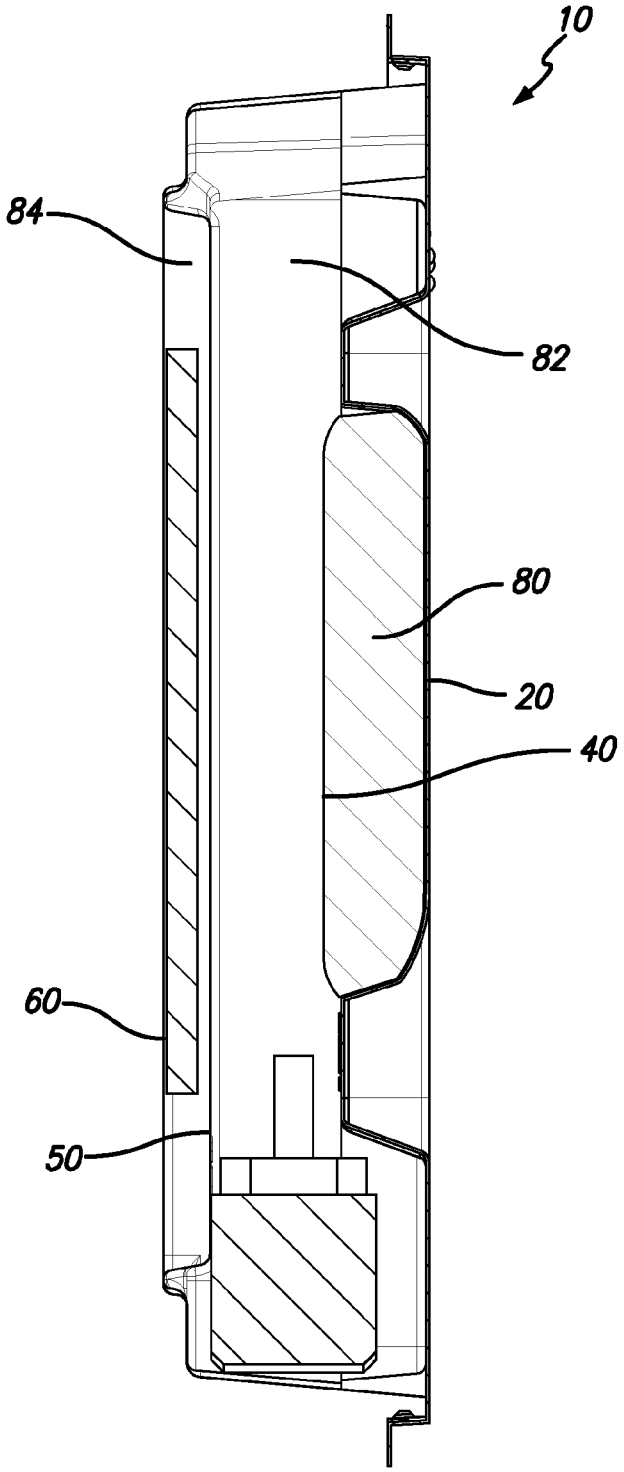
FIG. 4 is a cross-sectional view of the package of FIG. 1, taken along the line 4-4 in FIG. 1, to show the front, central, and rear compartments and their contents.

As perhaps best shown in the cross-section of FIG. 4, the front compartment 80 is formed between the outer shell face 20 and the inner shell face 40, and may have front compartment contents 90, for example an electronic product like a cellular phone, e-book reader, tablet computer, or any collectible item, toy, or similar device or object. The central compartment 82 is formed between the inner shell face 40 and the inner shell back 50, and may have central compartment contents 92, for example hardware accessories like a charger, power supply, carrying case, wrist loop, cables, or spare batteries. The rear compartment 84 is formed between the inner shell back 50 and the outer shell back 60, and may have rear compartment contents 94, for example printed or electronic media like a user's manual, welcome kit, audio or video media or other data, coupon, promotional item, service agreement, software, required disclosures, product identification card bearing a product identifier 98 such as an UPC code, or other content.

Figure 7A:
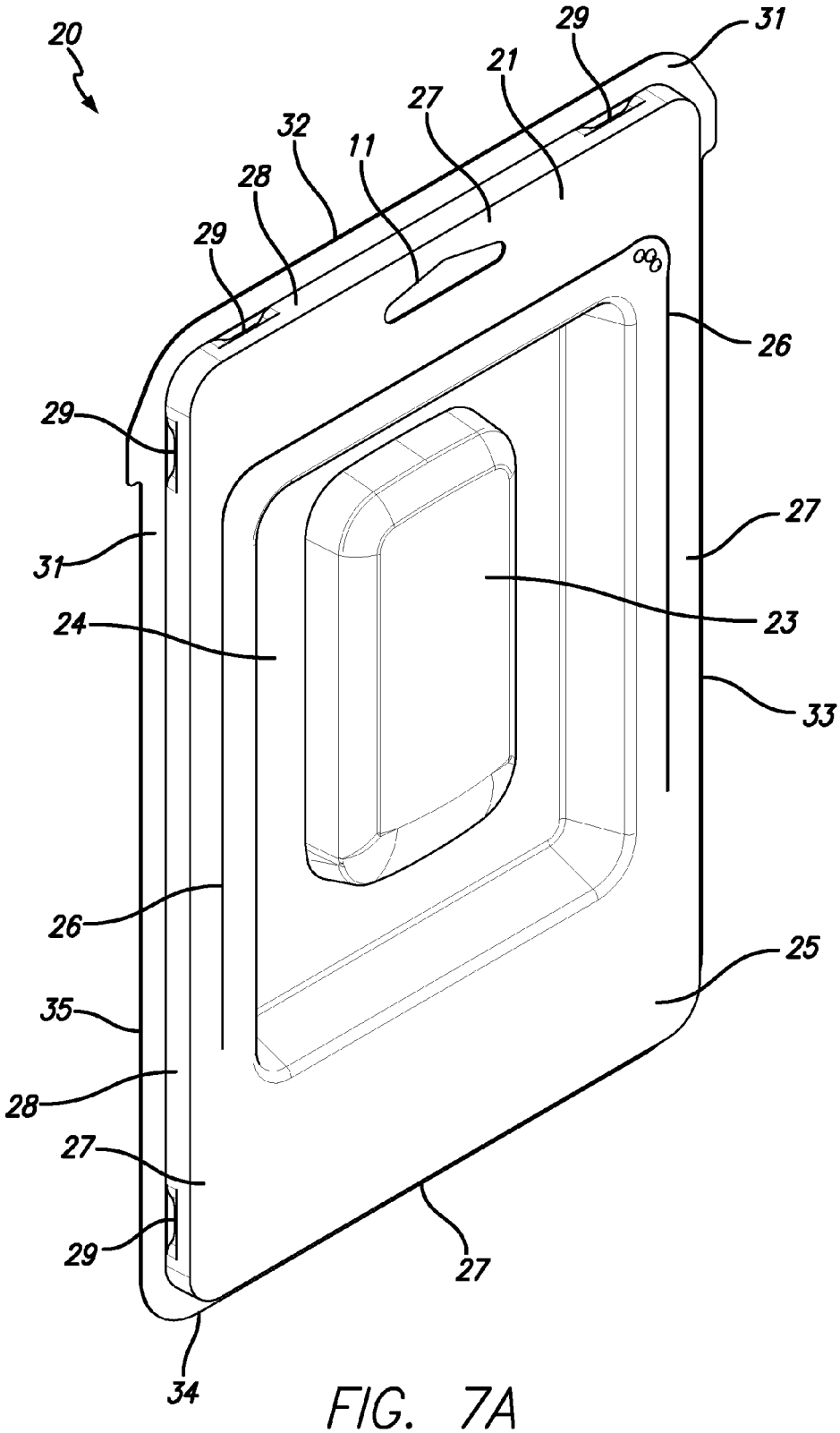
FIGS. 7A, 7B, and 7C are front perspective, rear perspective, and front elevation views of the outer shell face of the package of FIG. 1.
Figure 7B:
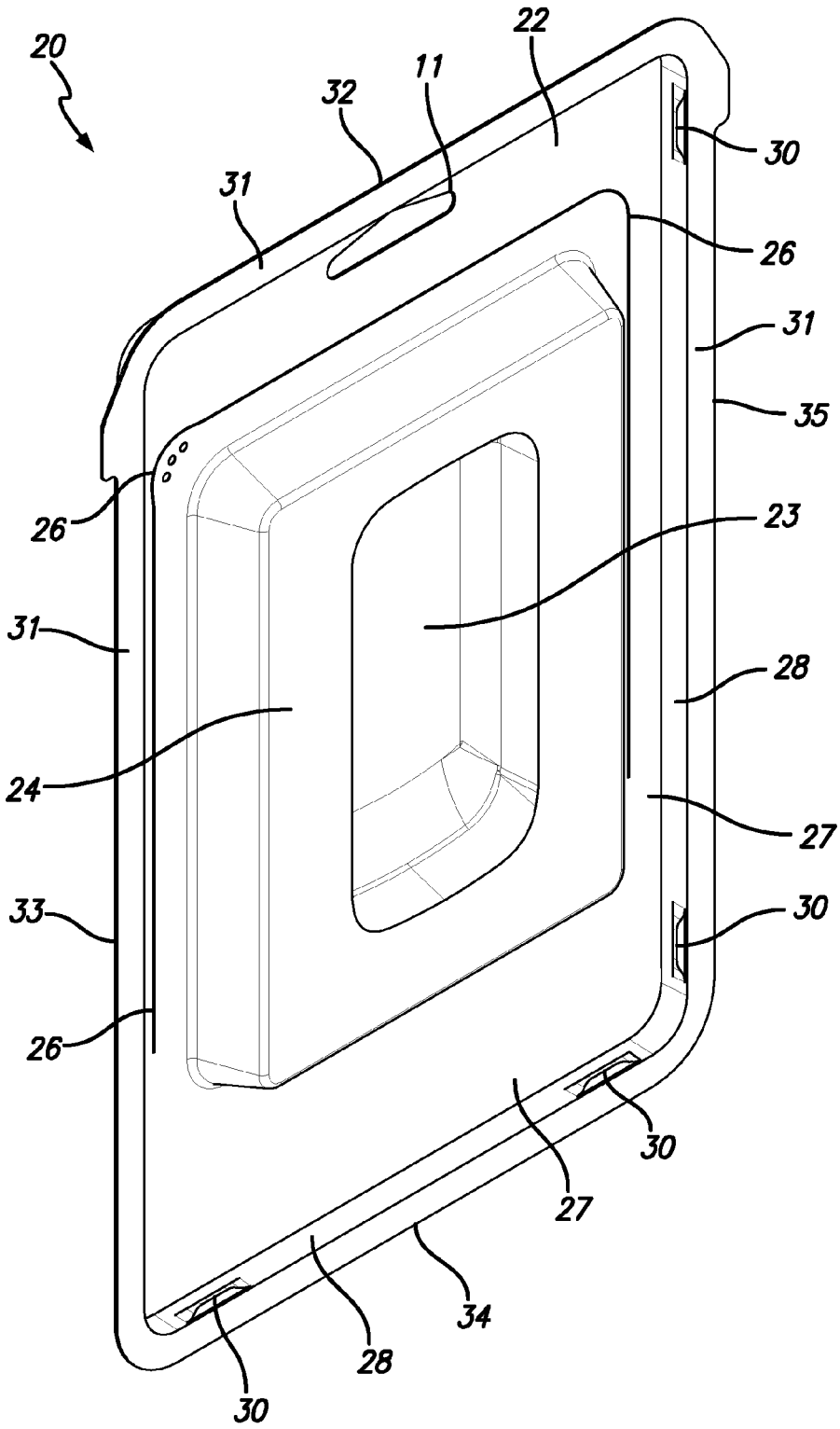
Figure 7C:
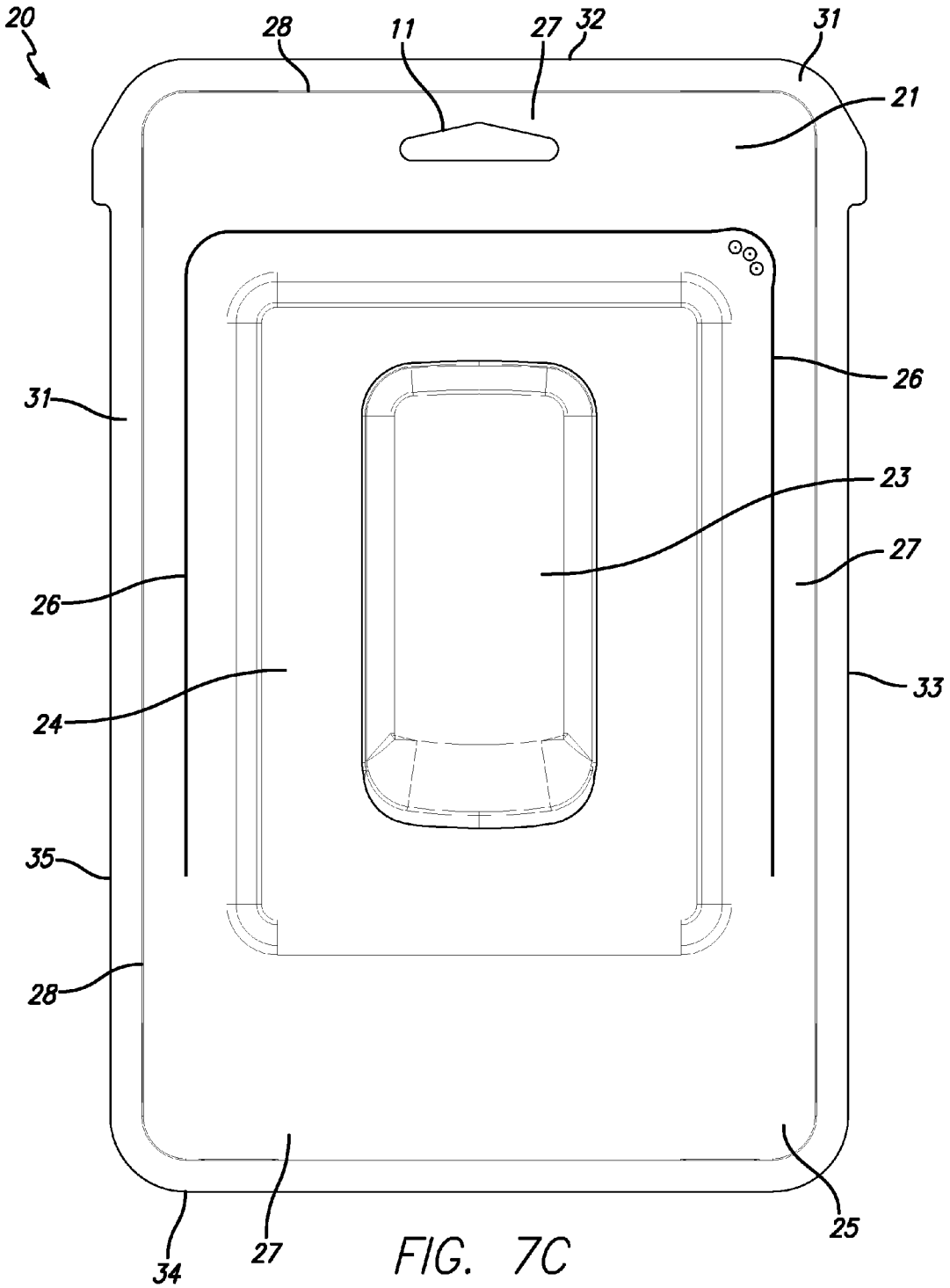

As perhaps best shown in FIGS. 7A-7C, the outer shell face 20 has an exterior face 21 and an interior face 22. The exterior face 21 may have a protrusion 23 shaped to fit or hold a product 90 for display, for example a cell phone. The protrusion 23 can be placed in a recess 24 to frame the displayed product 90. The forward surface of the protrusion 23 can be flush with the front surface 25 of the exterior face 21 of the outer shell face 20. The outer shell face 20 may include a perforation 26 partially or completely encircling the protrusion 23 or recess 24, to facilitate easy removal of the displayed product 90.

The outer shell face 20 has a periphery that may include a rim 27 and a sealing wall 28 with one or more indentations 29, adapted for mating with complementary structures on the outer shell back 60. The indentations 29 shown in the exterior view of FIG. 7A correspond to bumps 30 in the interior view of FIG. 7B. The periphery of the outer shell face 20 terminates in a peripheral flange 31 that includes a top edge 32, a right edge 33, a bottom edge 34, and a left edge 35.

Figure 8A:
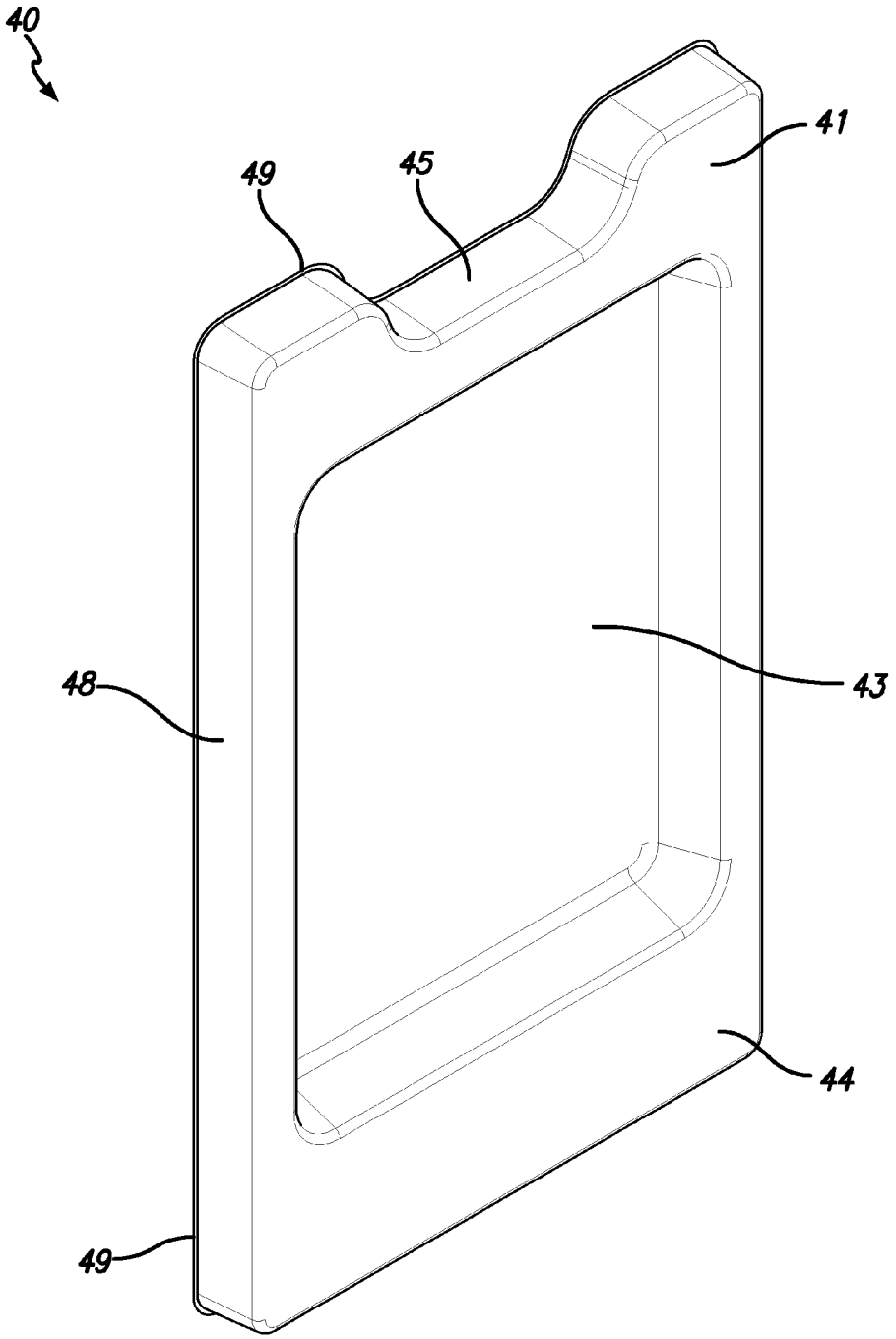
FIGS. 8A, 8B, and 8C are front perspective, rear perspective, and front elevation views of the inner shell face of the package of FIG. 1.
Figure 8B:
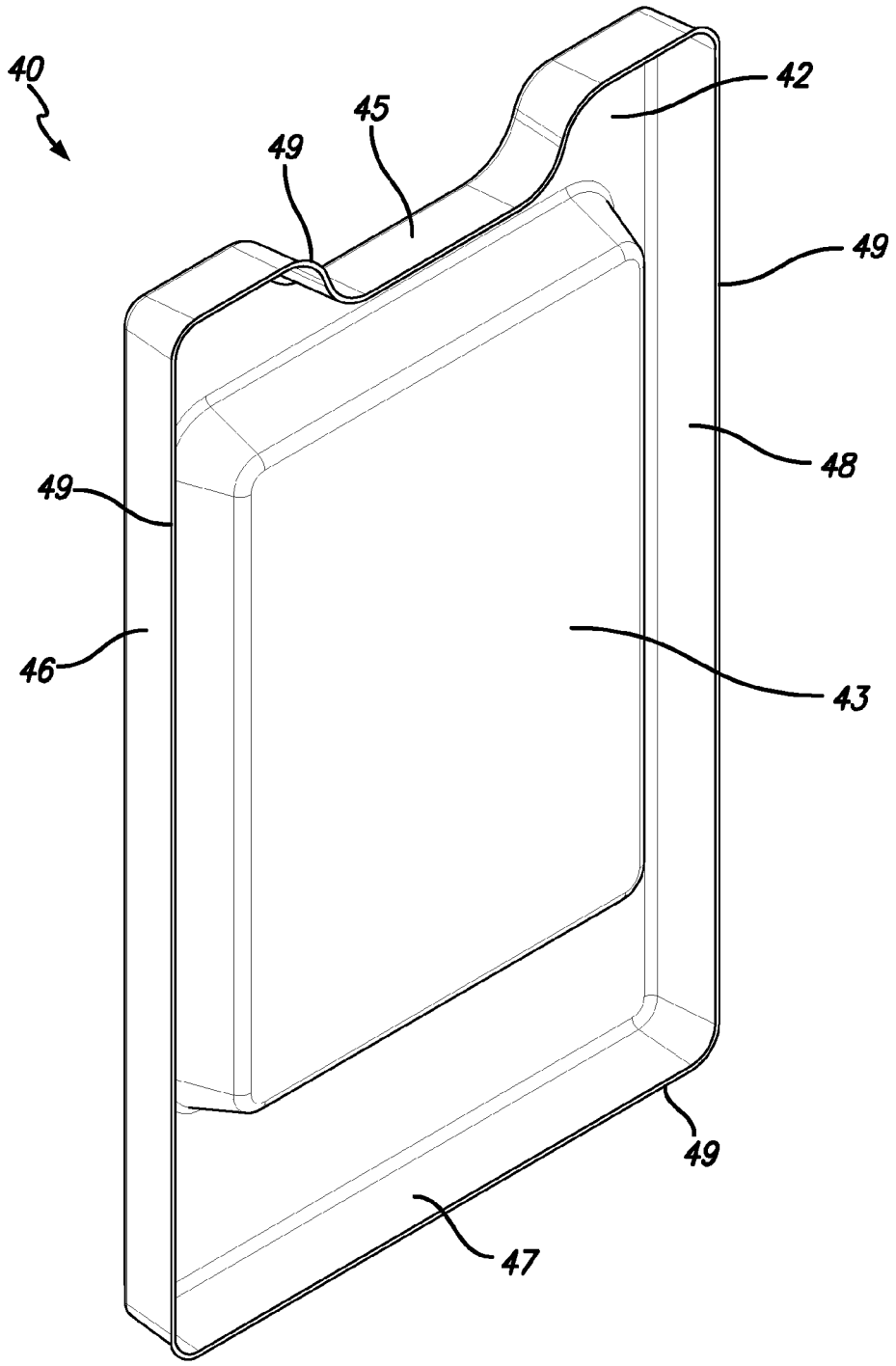
Figure 8C:
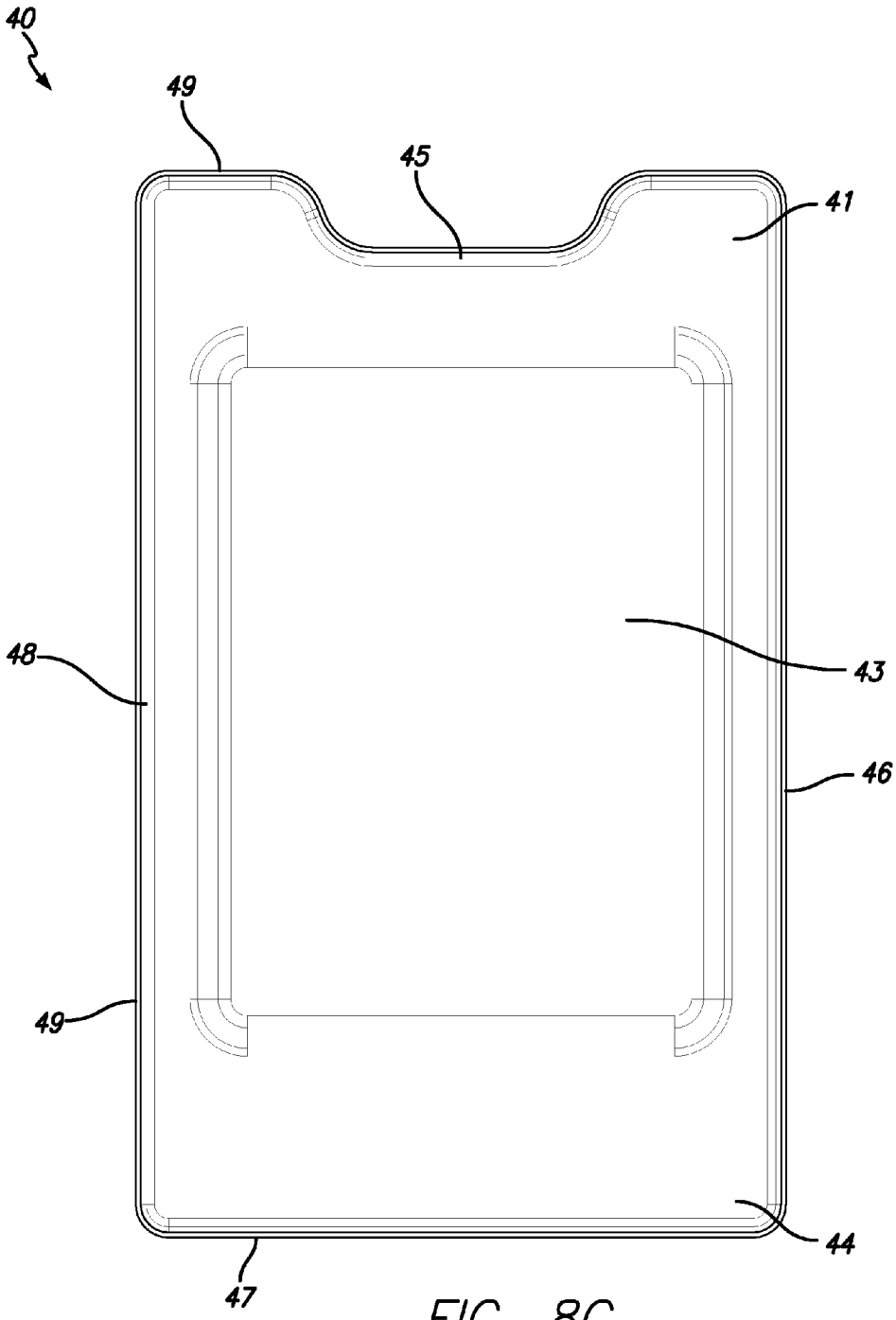
Figure 9A:
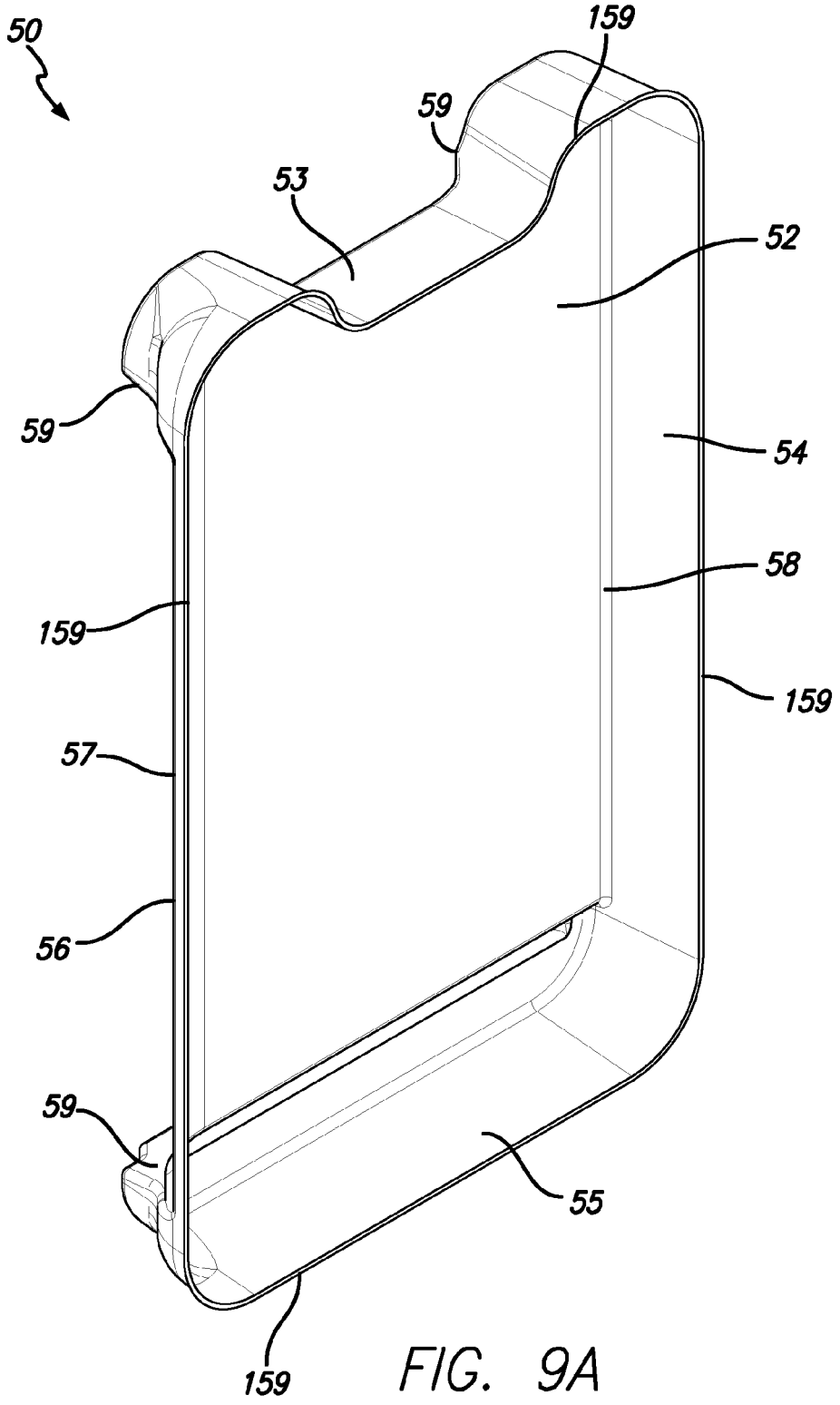
FIG. 9A is a front perspective view of the inner shell back of the package of FIG. 1, rotated to show the interior detail of the sharp corner.
Figure 9B:
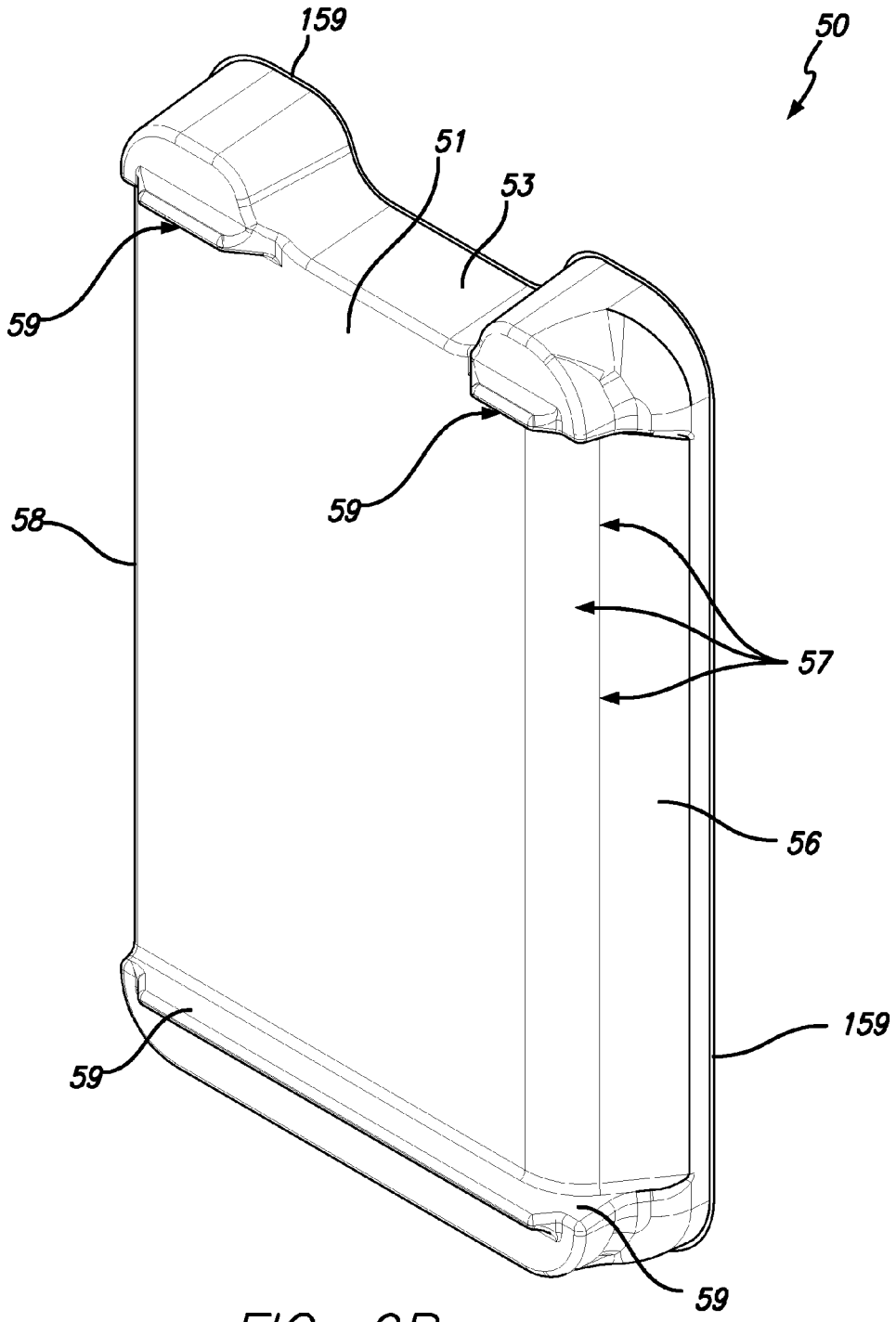
FIG. 9B is a rear perspective view of the inner shell back of the package of FIG. 1, rotated to show the exterior detail of the rounded corner.
Figure 9C:
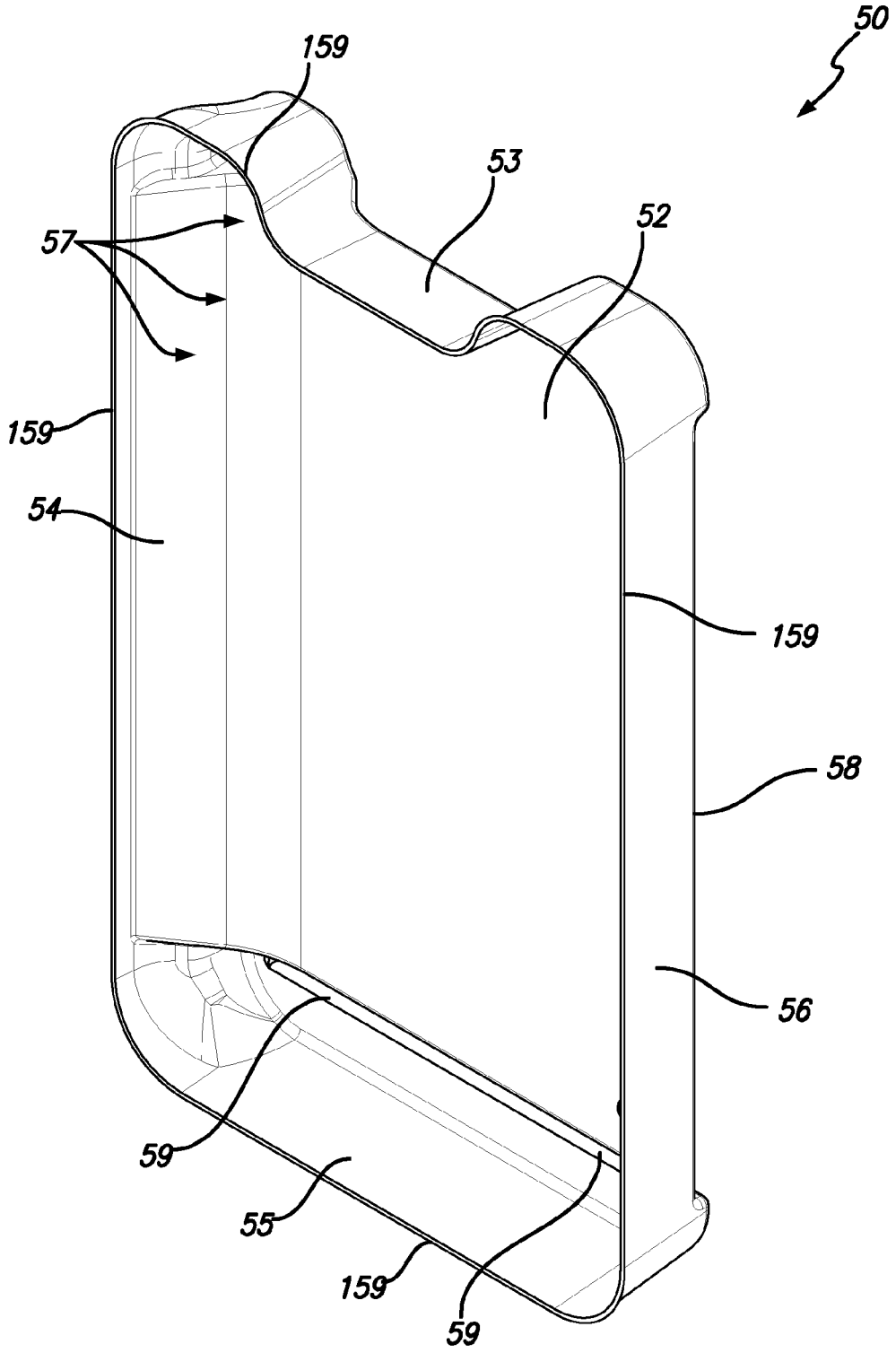
FIG. 9C is a front perspective view of the inner shell back of the package of FIG. 1, rotated to show the interior detail of the rounded corner.
Figure 9D:
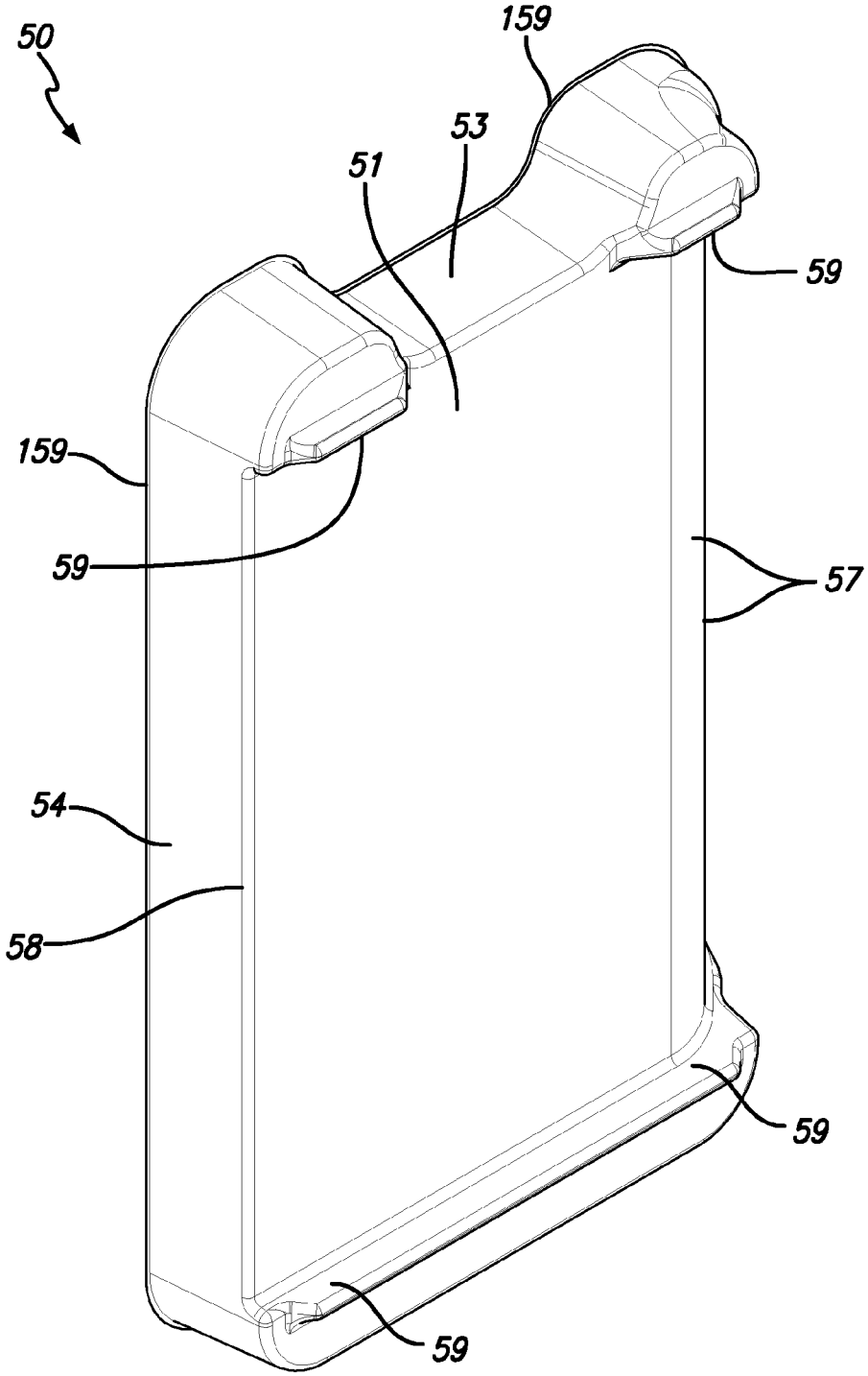
FIG. 9*d* is a rear perspective view of the inner shell back of the package of FIG. 1, rotated to show the exterior detail of the sharp corner.
Figure 9E:
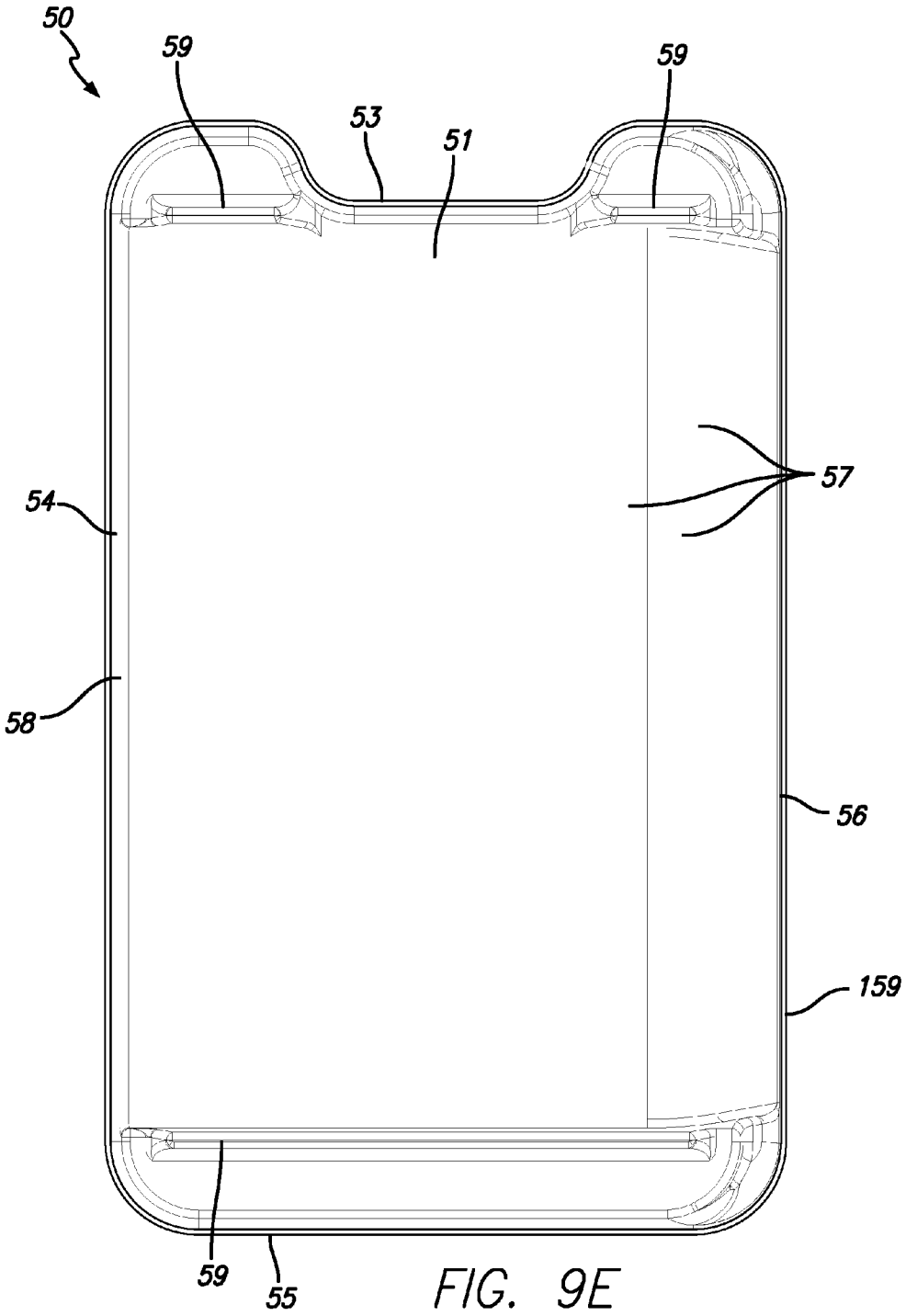
FIG. 9E is a rear elevation view of the inner shell back of the package of FIG. 1.

As shown in FIGS. 8A-8C, the inner shell face 40 has an exterior face 41 and an interior face 42. The exterior face 41 may have a recess 43 shaped and dimensioned to receive the recess 24 of the outer shell face 20 when the outer shell face 20 is nested together with the inner shell face 40 as shown in the cross-sectional view of FIG. 4. The inner shell face 40 includes a front surface 44 surrounding the recess 43, and a top side wall 45, a right side wall 46, a bottom side wall 47, and a left side wall 48, all terminating in a peripheral edge 49.

As shown in FIGS. 9A-9E, the inner shell back 50 has an exterior face 51 and an interior face 52, and includes a top side wall 53, a (lateral) right side wall 54, a bottom side wall 55, and a (lateral) left side wall 56, all terminating in a peripheral edge 159. Importantly, the left side wall 56 meets the exterior face 51 at a rounded corner 57 (best shown in FIGS. 9B, 9C, & 9E). In contrast, the right side wall 54 meets the exterior face 51 at a relatively sharp corner 58 (best shown in FIGS. 9A, 9D, & 9E). Guide rails 59 pare preferably provided, for example as raised protrusions along the upper and lower ends of the inner shell back 50. It is not required that the rounded corner and aperture appear on the left side, or that the sharp corner appear on the right side. Each of these features could appear on different or multiple sides.

As perhaps best shown in FIGS. 10A-10E, the outer shell back 60 has an exterior face 61 and an interior face 62. The outer shell back 60 includes a central cavity 63 surrounded by a top side wall 64, a (lateral) right side wall 65, a bottom side wall 66, and a (lateral) left side wall 67. The periphery of the outer shell back 60 is formed to mate with complementary structures on the periphery of the outer shell face 20, and includes a rim 68, a sealing wall 69 with one or more indentations 70, and terminates in a peripheral flange 71 extending to a peripheral edge 179.

Figure 10A:
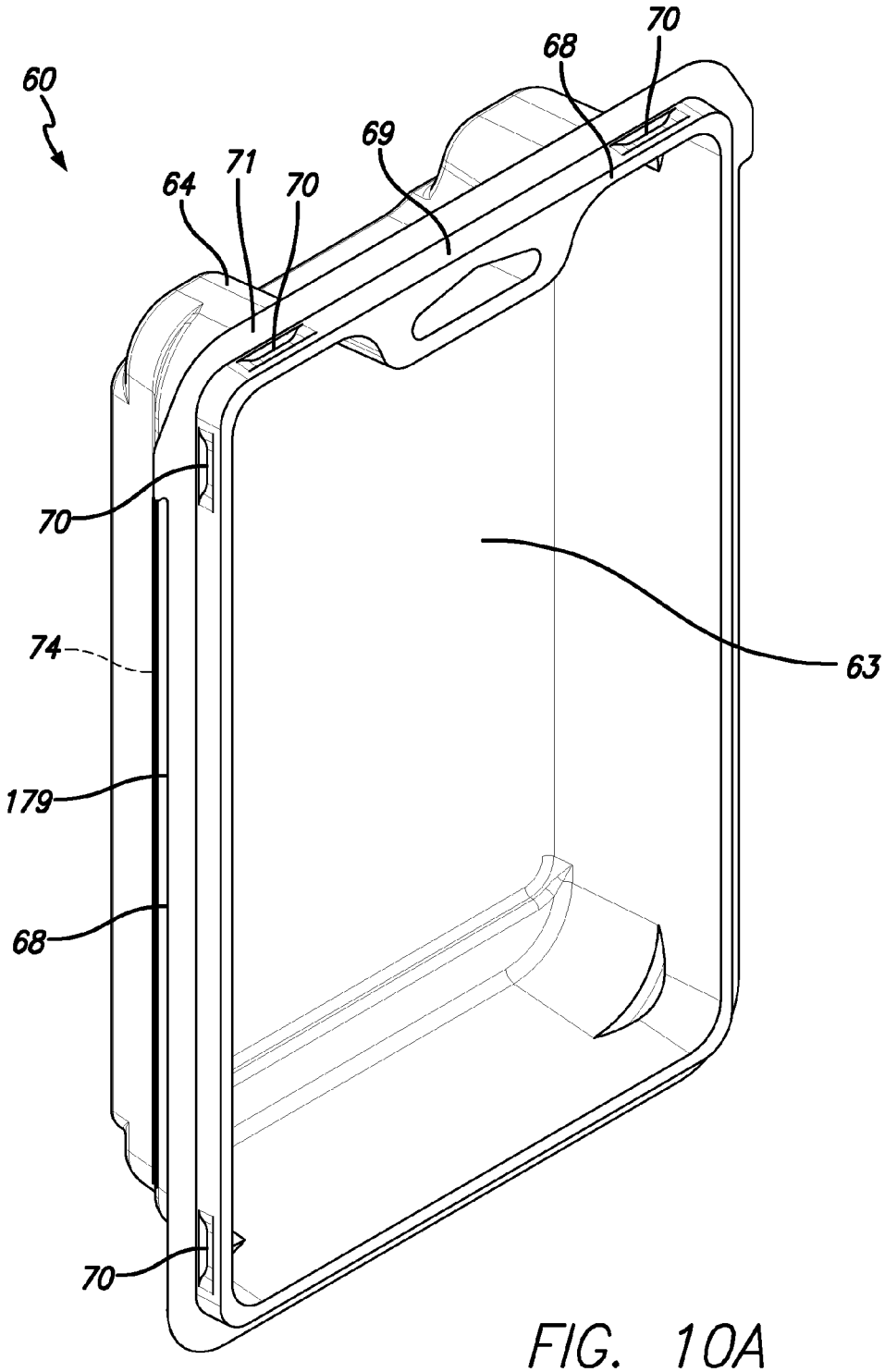
FIG. 10A is a front perspective view of the outer shell back of the package of FIG. 1, rotated to show the interior detail of the right (non-aperture) side.
Figure 10B:
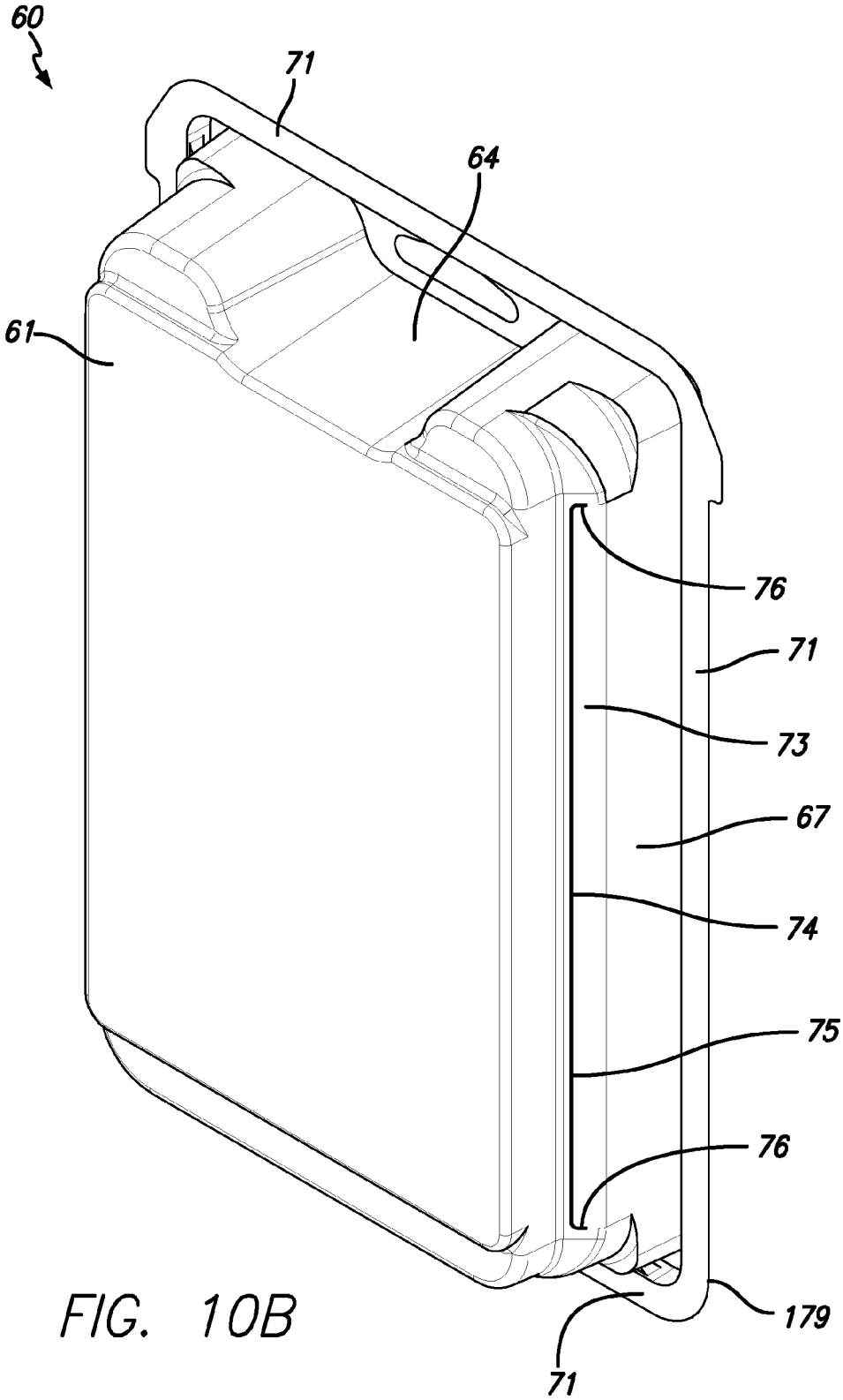
FIG. 10B is a rear perspective view of the outer shell back of the package of FIG. 1, rotated to show the exterior detail of the left (aperture) side.
Figure 10C:
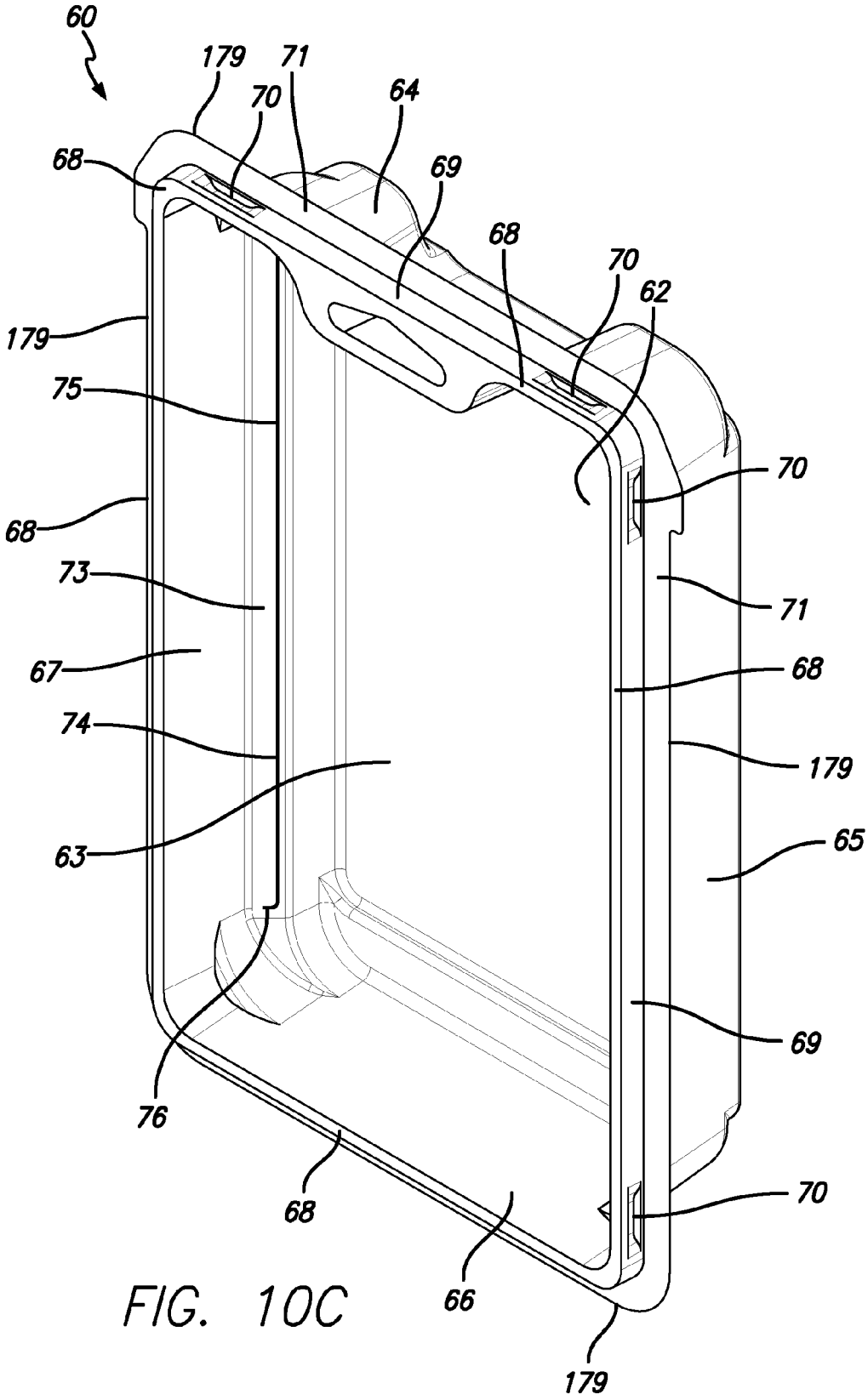
FIG. 10C is a front perspective view of the outer shell back of the package of FIG. 1, rotated to show the interior detail of the left (aperture) side.
Figure 10D:
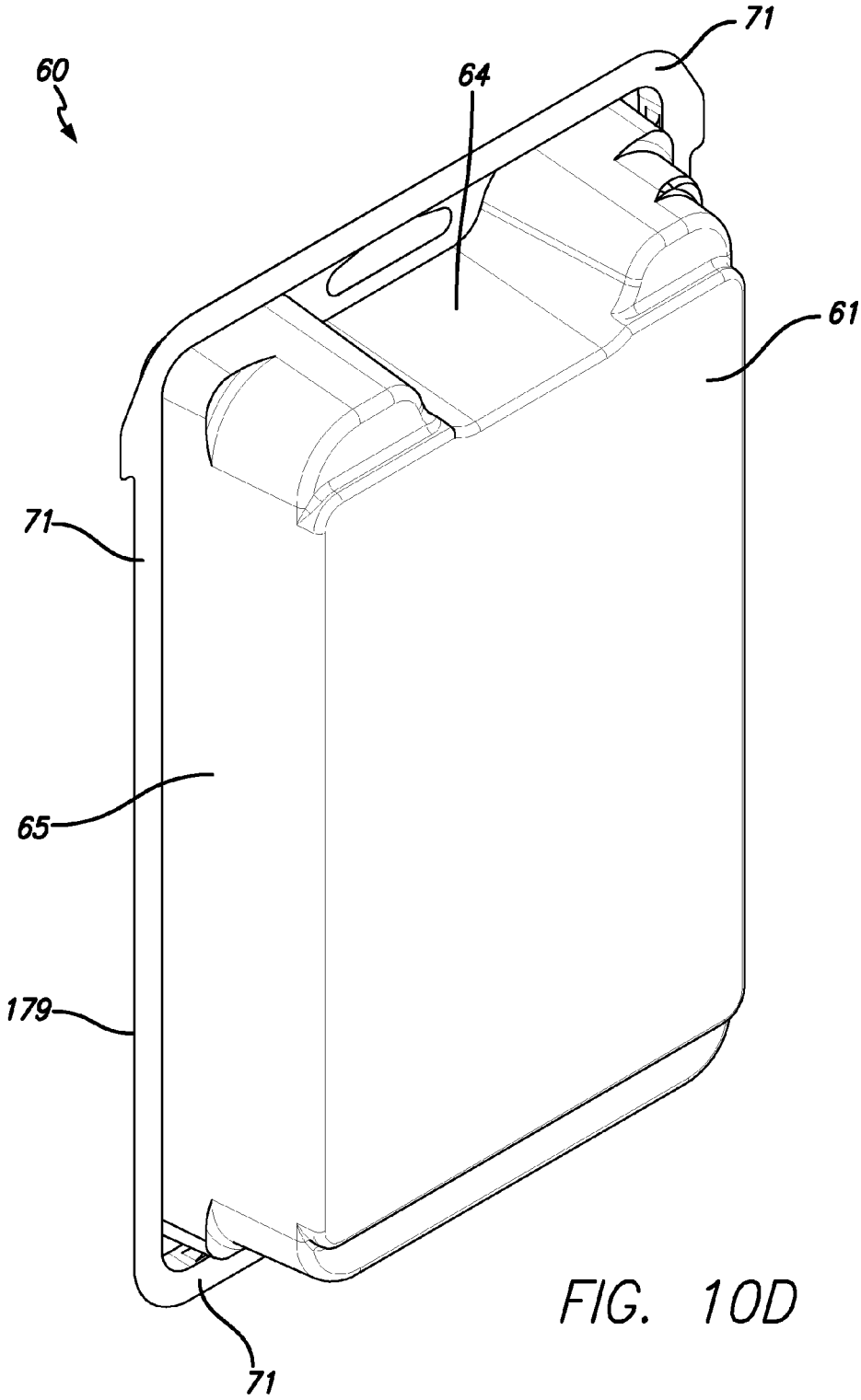
FIG. 10D is a rear perspective view of the outer shell back of the package of FIG. 1, rotated to show the exterior detail of the right (non-aperture) side.
Figure 10E:
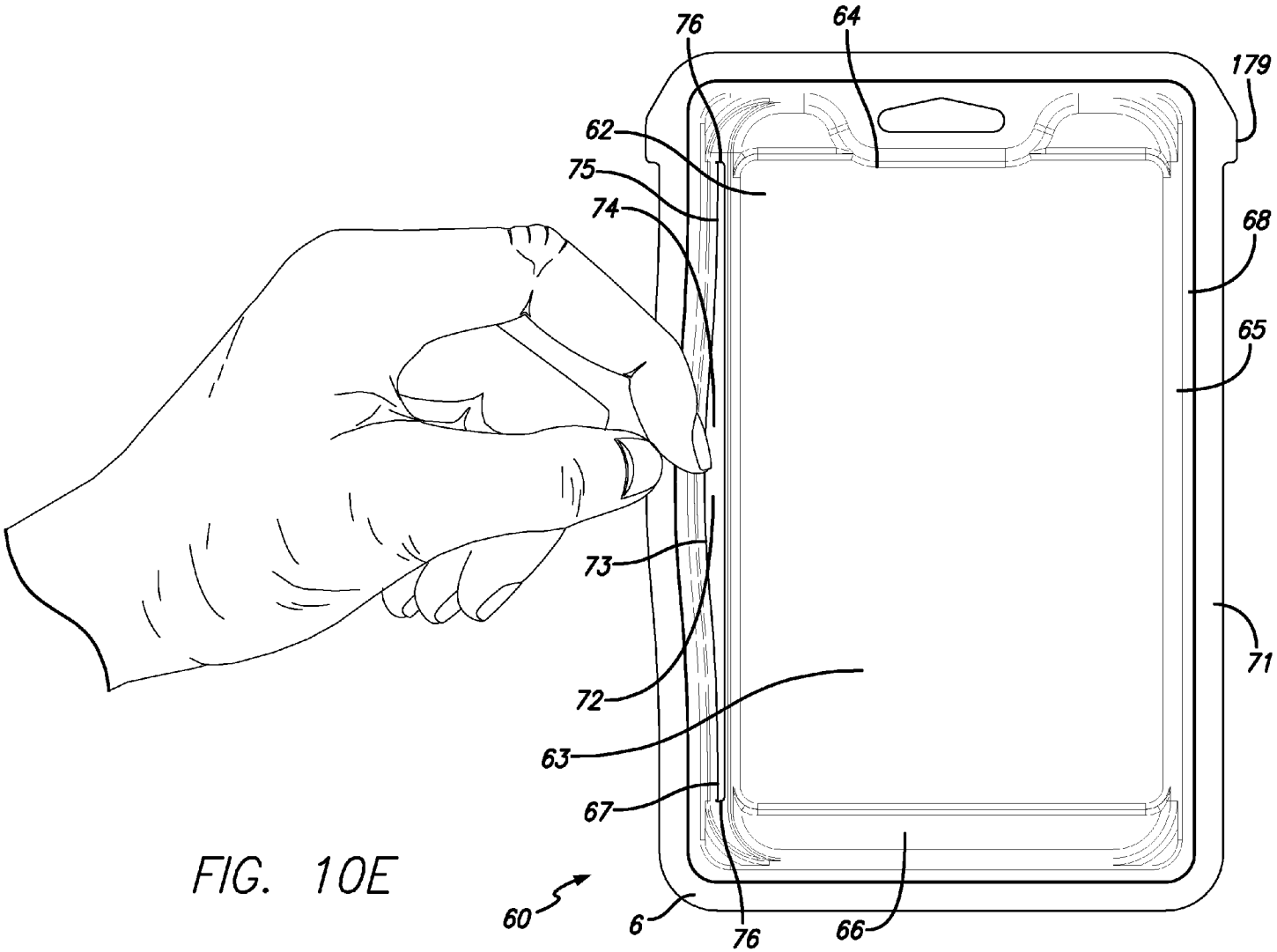
FIG. 10E is a view of the outer shell back of the package of FIG. 1, with the aperture spread open by fingers.

As shown in FIG. 10E in a spread-apart position, the outer shell back 60 has an aperture 72. As perhaps best shown in FIG. 10B, the aperture 72 can be formed as a flap 73 and a slot 74, with the slot 74 formed as a vertical cut 75 and a hinge cut 76.

Figure 11:
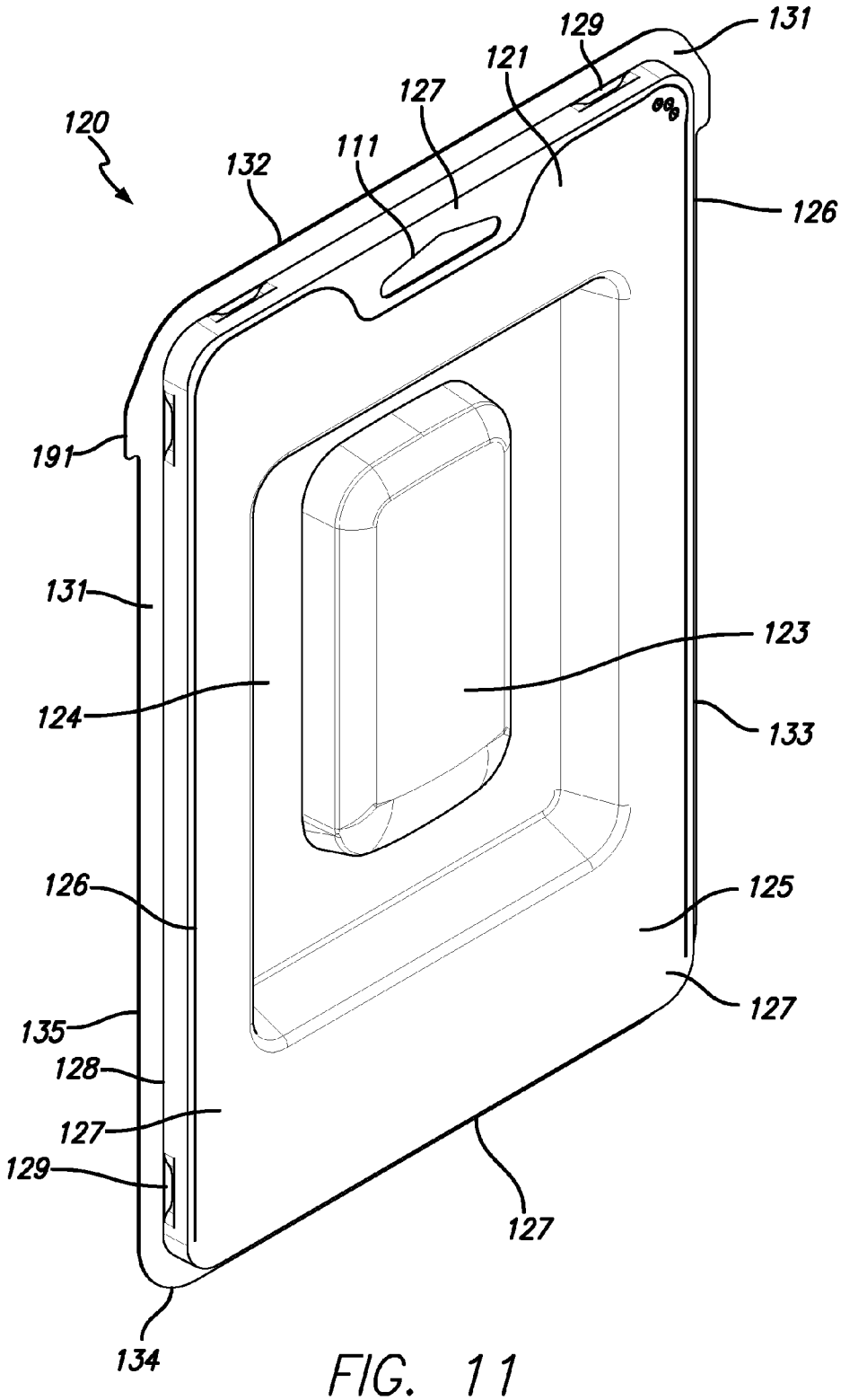
FIG. 11 is a perspective view of an alternative outer shell face for the package of FIG. 1.
Figure 12:
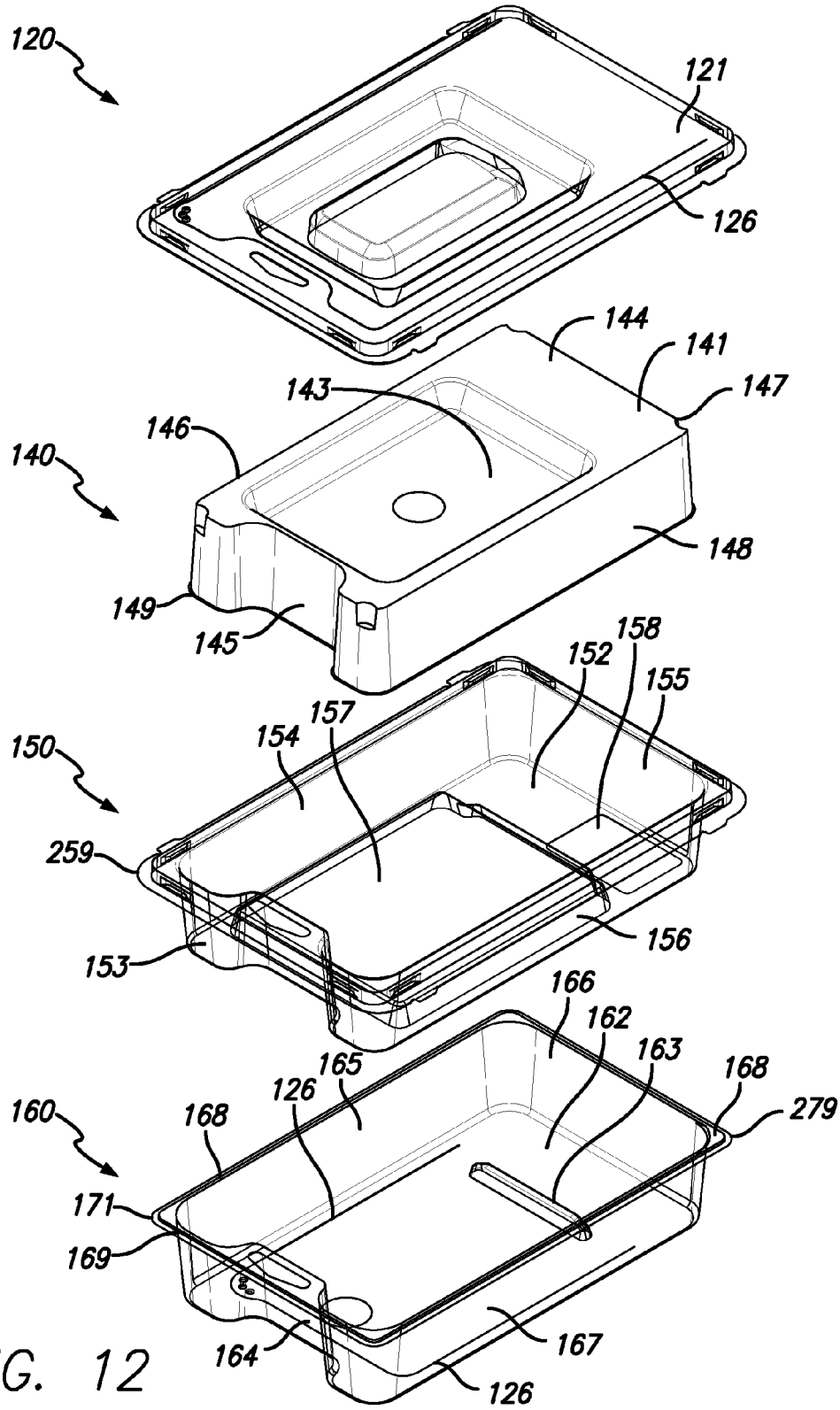
FIG. 12 is an exploded perspective view of an exemplary retail phone package according to a second embodiment of the invention, without any outer sleeve.

FIG. 11 shows an alternative outer shell face 220 for the package of FIG. 1, where the perforations 226 are located closer to the periphery of the outer shell face 220, providing easy-open access to the entire contents of the package.

FIGS. 12-15 provide views of an exemplary retail phone package 110 according to a second embodiment of the invention. As perhaps best shown in the exploded view of FIG. 12, the second package 110 may comprise four pieces: an outer shell face 120, an inner shell face 140, an inner shell back 150, and an outer shell back 160 made of thermoformed plastic.

The outer shell face 120 has an exterior face 121 and an interior face 122 (not shown), with a protrusion 123 shaped and adapted to fit or hold a product framed in a recess 124 on the front surface 125. The outer shell face may include a perforation 126 adjacent to the rim 127, sealing wall 128, and peripheral flange 131. The sealing wall 128 includes one or more indentations 129 which form bumps 130 on the inside surface of the sealing wall 128 for mating with complementary structures on the outer shell back 160. The outer shell face has a top edge 132, a right edge 133, a bottom edge 134, and a left edge 135.

The inner shell face 140 has an exterior face 141 and an interior face 142 (not shown), with a recess 143 shaped and positioned to receive the recess 124 in the outer shell face 120. The inner shell face 140 includes a front surface 144, a top side wall 145, a right side wall 146, a bottom side wall 147, and a left side wall 148, all terminating in a peripheral edge 149.

The inner shell back 150 has an exterior face 151, and an interior face 152, with a top side wall 153, a right side wall 154, a bottom side wall 155, and a left side wall 156, all terminating in a peripheral edge 259 and peripheral flange 171. The inner shell back 150 may also include a book receptacle 157, for example to hold a book or other media, and an identification area 158 for placement of product identifiers 198 or other information about the product, such as serial numbers, radio frequency identification tags, bar codes, or a UPC on either the interior face 152 or exterior face 151. The inner shell back 150 may include indentations 170 that extend into a deep mating channel 173. The inner shell back 150 may also include a notch 172, as perhaps best shown in FIG. 13.

The outer shell back 160 has an exterior face 161, and an interior face 162, with a ridge 163 configured and positioned to mate with the notch 172 of the inner shell back 150. The outer shell back 160 includes a top side wall 164, a right side wall 165, a bottom side wall 166, and a left side wall 167, each terminating in a rim 168, sealing wall 169, peripheral flange 271, and peripheral edge 279.

Figure 13:
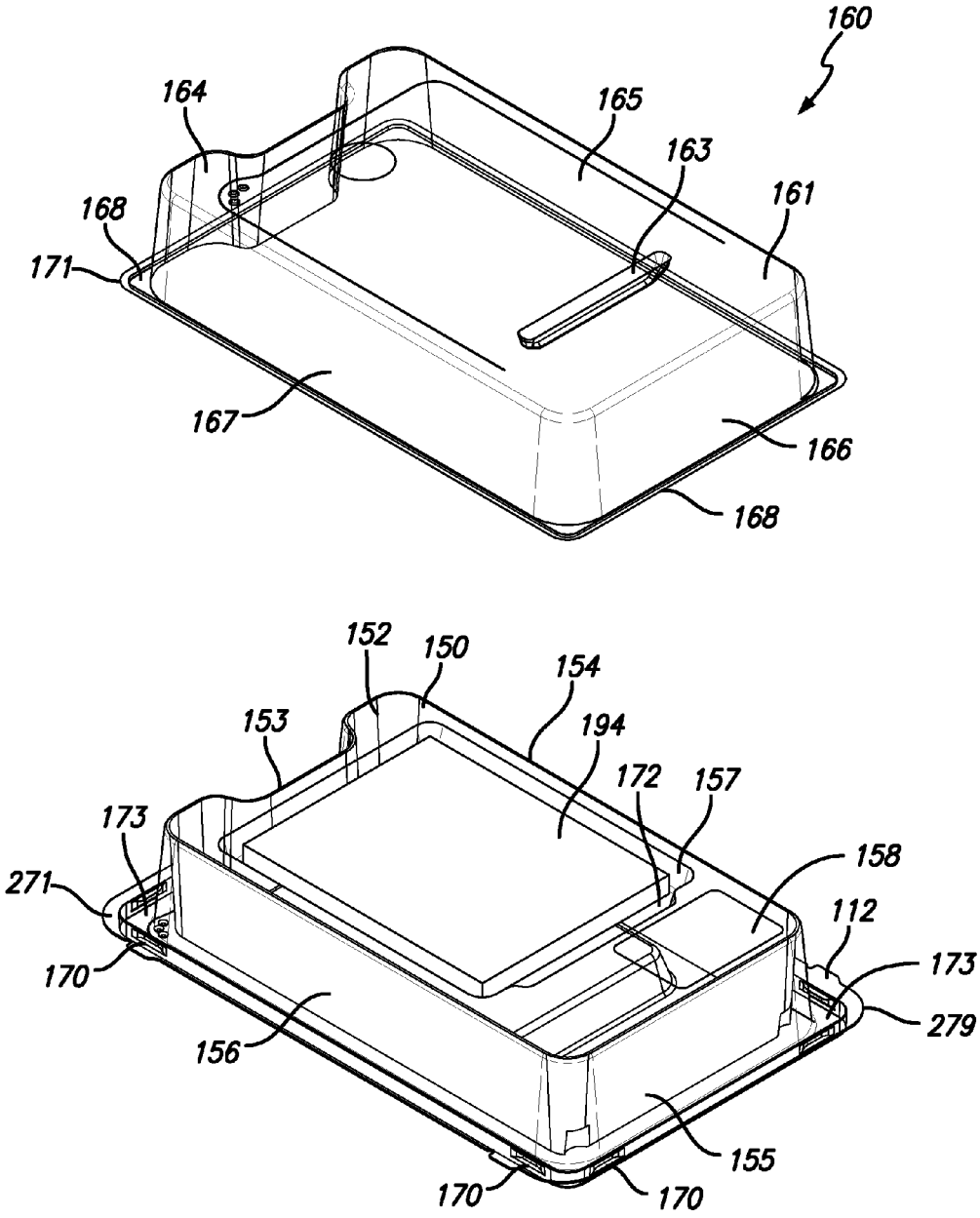
FIG. 13 is an exploded perspective view of the outer shell back positioned for mating with the partially assembled package comprising the outer shell face, inner shell face, inner shell back (and package contents) according to the second embodiment of the invention.
Figure 14:
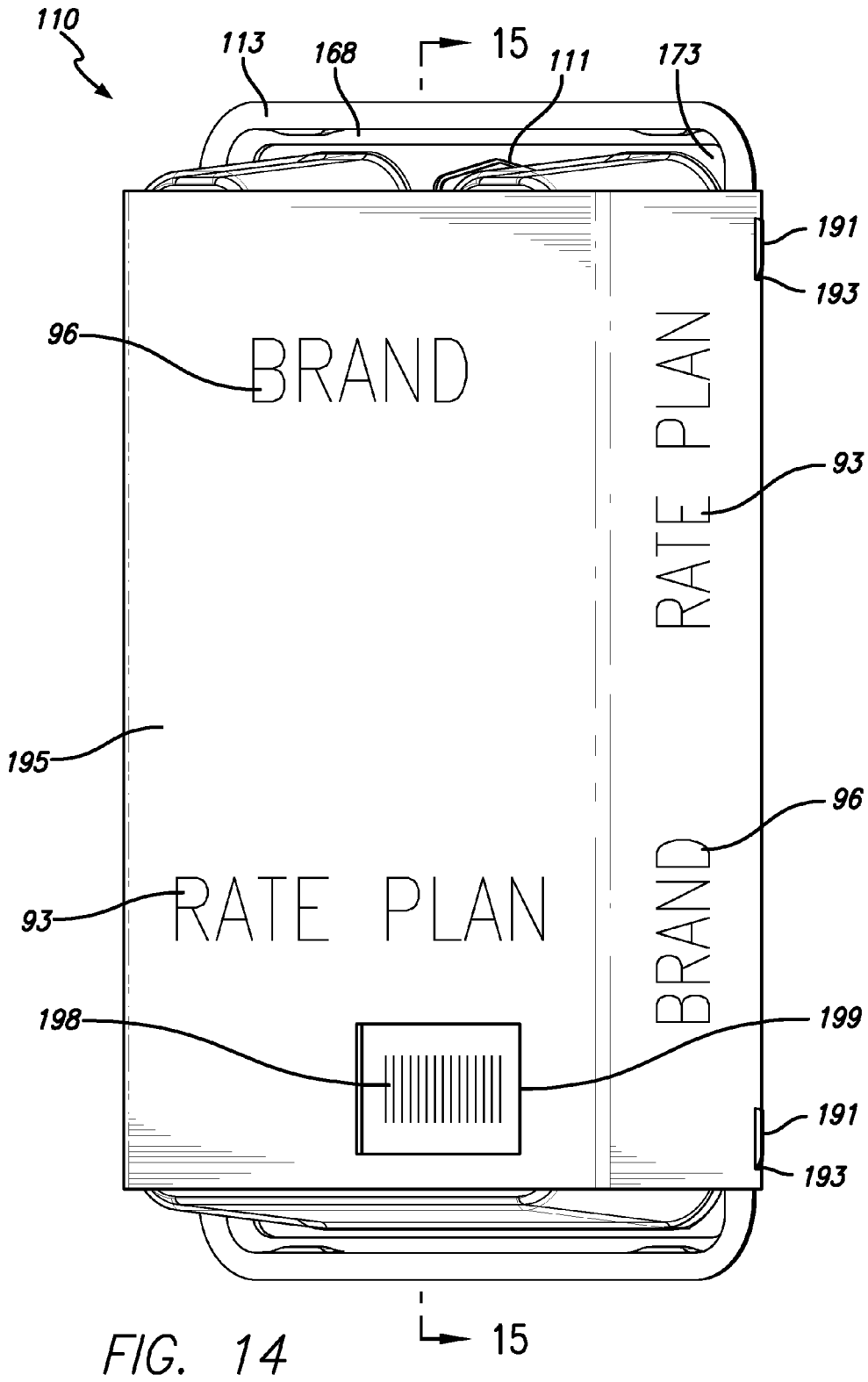
FIG. 14 is a rear perspective view of a package comprising the components of FIG. 12, with the outer sleeve in place to form a finished package.

As shown in FIG. 13, the outer shell back 160 can be positioned for mating with the partially assembled package 196 comprising the outer shell face 120, inner shell face 140, and inner shell back 150 (with package contents, if any), to form the finished package 110 (minus the outer sleeve 195). FIG. 14 shows the finished package 110 comprising the components of FIG. 12, with the outer sleeve 195 in place. The outer sleeve 195 may include a UPC or identifier window 199. Similar to the first package 10, the second package 110 may have a hanger loop 111 for retail display, and may be sealed to protect its contents along an at least partially sealed periphery 112 with a flange 113. The second package 110 has a front or frontispiece 114, a rear, back, or posterior 115, a top 116, a right side 117, a bottom 118, and a left side 119.

Figure 15:
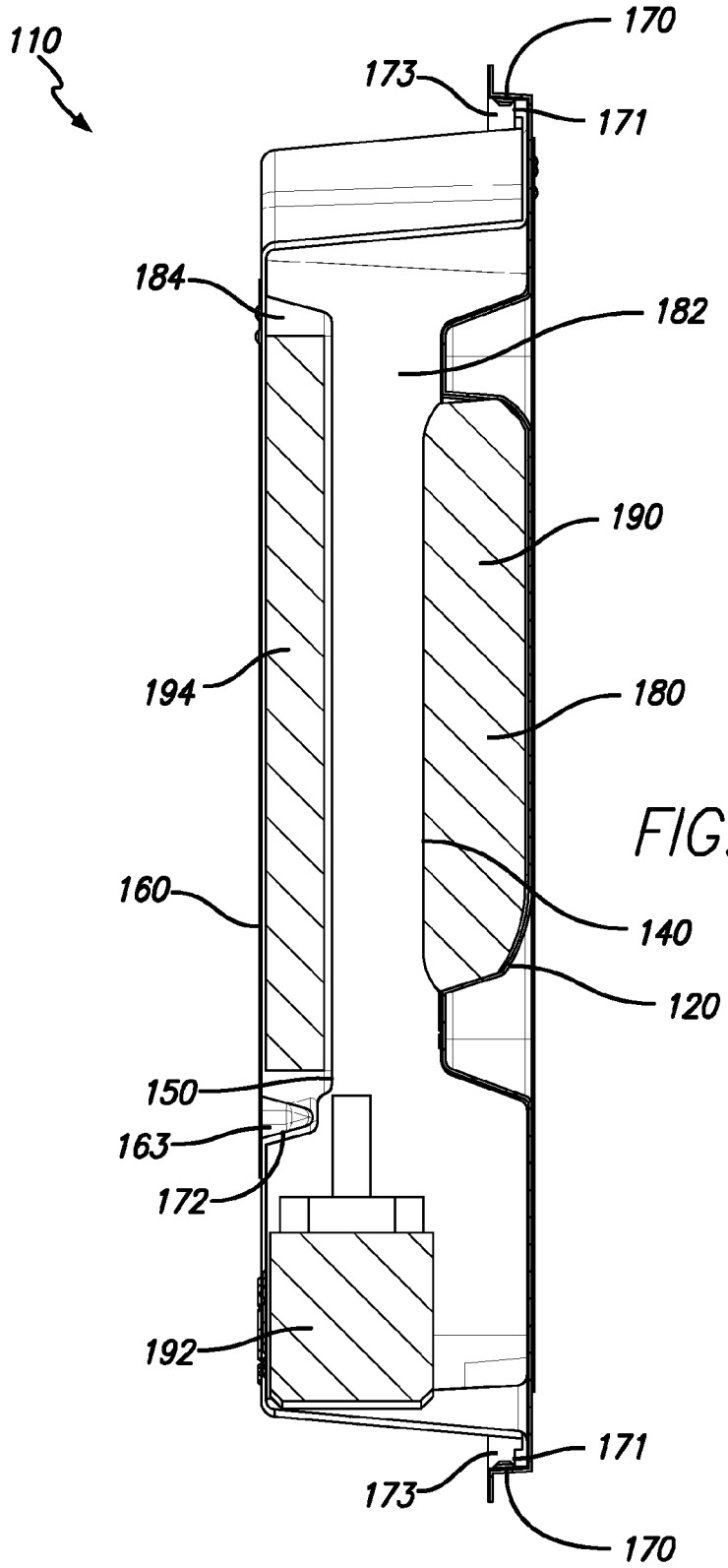
FIG. 15 is a cross-sectional view of the finished package of FIG. 14, taken along the line 15-15 in FIG. 14 to show the compartments and their contents.

As perhaps best shown in the cross-section of FIG. 15, the second package 110 may also include three compartments: a front compartment 180 between the outer shell face 120 and the inner shell face 140, a central compartment 182 between the inner shell face 140 and the inner shell back 50, and a rear compartment 184 between the inner shell back 150 and the outer shell back 160. The package 110 may contain a product 190 in the front compartment 180, accessories 192 in the central compartment 182, and documentation or other rear compartment contents 194 in the rear compartment 184.

In the package 110, both the outer shell face 120 and the outer shell back 160 have perforations 126 for easy-open. As perhaps best shown in FIG. 14, the second package 110 may include ears 191, for example on the upper and lower ends of the right and left side edges, extending through slots 193 in the outer sleeve 195, to help keep the sleeve 195 in place.

While the exemplary packages 10 and 110 each comprise four separate pieces (outer shell face, inner shell face, inner shell back, outer shell back), this is not required and a different number of separate pieces could be used. For example, the outer shell face and outer shell back could be joined by a hinge into a unitary "clamshell". The inner shell face and inner shell back, or some other combination of pieces, could similarly be joined.

While the exemplary package 10 includes three compartments (front compartment 80, central compartment 82, rear compartment 84), this is not required and a greater or fewer number of compartments could be used. For example, a compartment could be divided to form a different number of compartments for particular applications. The package as a whole or the individual compartments could be different sizes and/or shapes. Instead of four separate pieces to form a package with three separate compartments, three separate pieces could be used to form a package with two separate compartments or greater number of pieces could be used to form a package with more compartments.

The components of the packages 10 and 110 are preferably made using thermoforming methods, from a suitable thermoformable material, such as a thermoformable plastic such as oriented polystyrene (OPS), talc-filled polypropylene (TFPP), polypropylene (PP), high impact polystyrene (HIPS), polyethylene terepthalate (PET), amorphous PET (APET), crystalline polyethylene (CPET) polystyrene copolymer blends, styrene block copolymer blends, and the like. The material is not necessarily homogeneous, but may be, for example, a laminate, co-extruded material, or multi-layer material. In an appropriate case, one or more of these components could also be made of different formable, molded, or folded materials, for example metal, foil, or a cardboard or paper sheet material that is or could be recycled instead of, or in combination with, thermoformable plastic.

The component pieces forming the package 10 may be made of different materials. For example, the outer shell face 20 and outer shell back 60 may be made of transparent material to allow viewing of the contents of the front compartment 80 and the rear compartment 84. The inner shell face 40 and inner shell back 50 may be made of opaque material to obscure the contents of the central compartment 82.

While the packages 10 and 110 have been described in context of consumer electronic sales, this is not required and the packages could be used for other purposes. For example, a package according to the invention could be used for food products, with the front and/or central compartments holding non-perishable or perishable food items, and the rear compartment holding a different food or other meal-related materials. The rear compartment could also hold a removable hot or cold pack, either passive or chemically activated.

It is understood that the invention is not confined to the embodiments set forth herein as illustrative, but embraces all such forms thereof that come within the scope of the following claims.

What is claimed is:

1. A thermoformed container comprising:

an outer shell face made of thermoformed plastic and having an outer shell face periphery;

an inner shell face having an inner shell face periphery;

an inner shell back having an inner shell back periphery; and an outer shell back made of thermoformed plastic and having an outer shell back periphery;

wherein the outer shell face periphery and the outer shell back periphery are joined together to form an interior of the container and an exterior of the container;

wherein a front compartment is formed between the outer shell face and the inner shell face and a rear compartment is formed between the inner shell back and the outer shell back;

wherein the outer shell back includes at least one aperture shaped to pass a sheet material from the exterior of the container through the aperture and into the rear compartment;

wherein the outer shell face includes at least one protrusion shaped to receive a cell phone; and further comprising a cell phone positioned in the protrusion and within the front compartment.

2. The container of claim 1 wherein the outer shell back has a lateral side, and the aperture is located in the lateral side.

3. The container of claim 2 wherein the aperture includes a flap made as an elongated cut with hinge cuts at each end.

4. The container of claim 2 wherein the inner shell back includes a rounded corner adjacent to the aperture on the lateral side of the outer shell back.

5. The container of claim 2 wherein the inner shell back includes at least one guide rail.

6. The container of claim 1 wherein a central compartment is formed between the inner shell face and the inner shell back.

* * * * *